US011355294B2

(12) United States Patent
Kobayashi

(10) Patent No.: US 11,355,294 B2
(45) Date of Patent: Jun. 7, 2022

(54) PUSH SWITCH

(71) Applicant: Panasonic Intellectual Property Management Co., Ltd., Osaka (JP)

(72) Inventor: Yuki Kobayashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/056,643

(22) PCT Filed: May 22, 2019

(86) PCT No.: PCT/JP2019/020229
§ 371 (c)(1),
(2) Date: Nov. 18, 2020

(87) PCT Pub. No.: WO2019/225635
PCT Pub. Date: Nov. 28, 2019

(65) Prior Publication Data

US 2021/0210292 A1 Jul. 8, 2021

(30) Foreign Application Priority Data

May 24, 2018 (JP) ..... JP2018-099353

(51) Int. Cl.
*H01H 13/14* (2006.01)
*H01H 13/26* (2006.01)
*H01H 13/52* (2006.01)

(52) U.S. Cl.
CPC ..... *H01H 13/14* (2013.01); *H01H 13/26* (2013.01); *H01H 13/52* (2013.01); *H01H 2215/004* (2013.01)

(58) Field of Classification Search
CPC ..... H01H 13/14; H01H 13/26; H01H 13/52; H01H 2215/004; H01H 13/50;
(Continued)

(56) References Cited

U.S. PATENT DOCUMENTS 7,105,761 B2 * 9/2006 Masuda ..... H01H 13/52 200/406
7,109,431 B2 * 9/2006 Yanai ..... H01H 13/48 200/341
(Continued)

FOREIGN PATENT DOCUMENTS

DE 102014219316 A1 3/2016
EP 1 387 375 A2 2/2004
(Continued)

OTHER PUBLICATIONS

International Search Report and Written Opinion issued in International Patent Application No. PCT/JP2019/020229, dated Jul. 30, 2019; with partial English translation.
(Continued)

*Primary Examiner* — Lheiren Mae A Caroc
(74) *Attorney, Agent, or Firm* — McDermott Will & Emery LLP

(57) ABSTRACT

A push switch includes: a case including a fixed contact; a movable member, a pushing element, and a support. The movable member includes a movable contact. The movable member is disposed at a location to face the fixed contact and is movable between an ON-position and an OFF-position. The pushing element is disposed at a location to face the movable member and is configured to receive external force to push the movable member. The support has such a property that until a travel distance of the pushing element reaches a first threshold, a load applied from the support to the pushing element increases, and when the travel distance of the pushing element reaches the first threshold, the load applied from the support 6 to the pushing element decreases.

12 Claims, 12 Drawing Sheets

(58) Field of Classification Search
CPC ..... H01H 13/06; H01H 13/10; H01H 13/48; H01H 3/12; H01H 5/30; H01H 2221/044; H01H 2221/036; H01H 2227/022; H01H 2221/032
USPC ..... 200/341, 520, 402, 405, 406, 408, 409, 200/302.2, 516
See application file for complete search history.

(56) References Cited

U.S. PATENT DOCUMENTS

| | | | | |
|---|---|---|---|---|
| 2003/0209418 | A1* | 11/2003 | Yanai | H01H 13/807 200/406 |
| 2006/0081452 | A1 | 4/2006 | Yanai et al. | |
| 2011/0203912 | A1 | 8/2011 | Niu | |
| 2014/0311882 | A1* | 10/2014 | Terashita | H01H 13/14 200/520 |

FOREIGN PATENT DOCUMENTS

| | | | |
|---|---|---|---|
| JP | 2004-071225 | A | 3/2004 |
| JP | 2006-107821 | A | 4/2006 |
| JP | 2006-120397 | A | 5/2006 |

OTHER PUBLICATIONS

Extended European Search Report dated Jul. 9, 2021, issued in the corresponding European Patent Application No. 19807062.5.

* cited by examiner

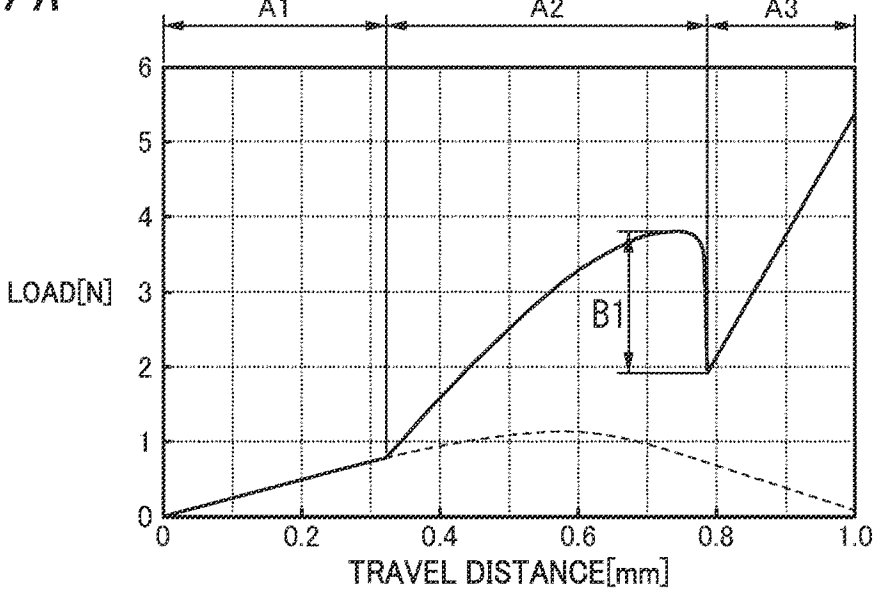
FIG. 7A
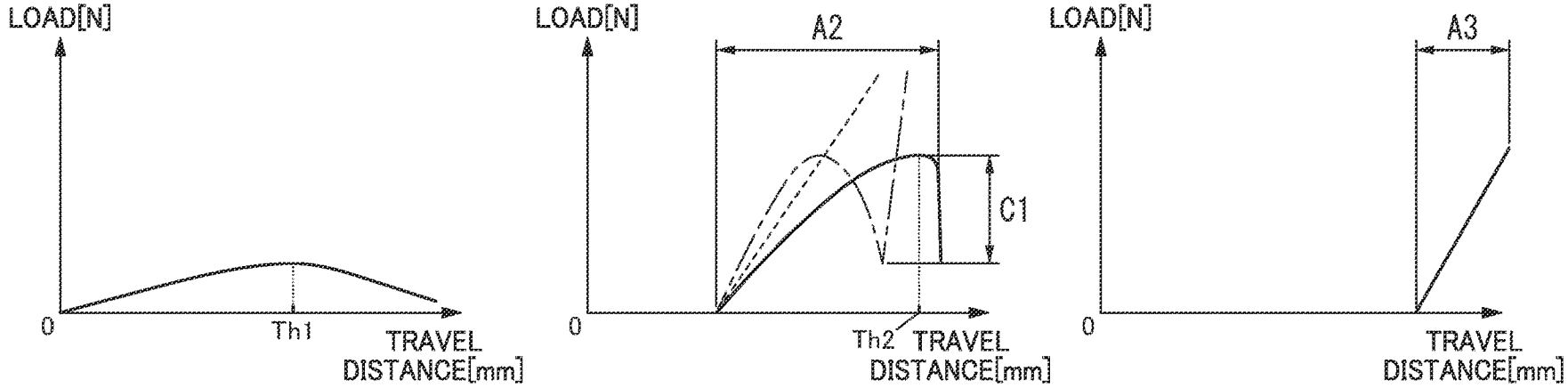
FIG. 7B
FIG. 7C
FIG. 7D

PUSH SWITCH

CROSS-REFERENCE OF RELATED APPLICATIONS

This application is the U.S. National Phase under 35 U.S.C. § 371 of International Patent Application No. PCT/JP2019/020229, filed on May 22, 2019, which in turn claims the benefit of Japanese Application No. 2018-099353, filed on May 24, 2018, the entire disclosures of which Applications are incorporated by reference herein.

TECHNICAL FIELD

The present disclosure generally relates to push switches, and specifically, to a push switch turned ON or OFF through deformation of a movable member.

BACKGROUND ART

Patent Literature 1 discloses a push-on switch. The push-on switch includes a case, a movable contact, a pressing section, and an elastic body. The case is made of an insulating resin and includes a plurality of fixed contacts. The movable contact is formed from a metal plate to have a dome shape and is configured to invert with comfortableness to bring the fixed contacts into contact with or separate from each other. The pressing section is accommodated in a recess formed in the case and is located at a certain distance from the movable contact. Receiving a push operation, the elastic body warps without comfortableness to move the pressing section up and down.

The push-on switch (push switch) described in Patent Literature 1 has the problem that when an operator gives a push operation to the elastic body (pushing element), comfortableness (click feeling) provided to the operator by the elastic body may be impaired as the movable contact (movable member) deforms.

CITATION LIST

Patent Literature

Patent Literature 1: JP 2006-120397 A

SUMMARY OF INVENTION

It is an object of the present disclosure to provide a push switch configured to provide comfortableness without significantly impaired to an operator when the operator gives a push operation to a push element.

A push switch according to one aspect of the present disclosure includes a case including a fixed contact, a movable member, a pushing element, and a support. The movable member includes a movable contact. The movable member is disposed at a location to face the fixed contact and is movable between an ON-position at which the movable contact is in contact with the fixed contact and an OFF-position at which the movable contact is apart from the fixed contact. The pushing element is disposed at a location to face the movable member and is configured to receive external force to push the movable member. The support is connected to the pushing element and supports the pushing element with respect to the case. The support has such a property that until a travel distance of the pushing element reaches a first threshold, a load applied from the support to the pushing element increases, and after the travel distance of the pushing element reaches the first threshold, the load applied from the support to the pushing element decreases. The movable member has such a property that until the travel distance of the pushing element reaches a second threshold, a load applied from the movable member to the pushing element increases, and when the travel distance of the pushing element reaches the second threshold, the load applied from the movable member to the pushing element decreases.

BRIEF DESCRIPTION OF DRAWINGS

FIG. 7A is a correlation diagram between the travel distance of the pushing element in the push switch and a load applied from the pushing element to an operator;

FIG. 7B is a correlation diagram between the travel distance of the pushing element and a load applied from the support to the pushing element;

FIG. 7C is a correlation diagram between the travel distance of the pushing element and a load applied from the pushing element and the movable member to the operator:

FIG. 7D is a correlation diagram between the travel distance of the pushing element and the load applied from the pushing element to the operator;

DESCRIPTION OF EMBODIMENTS (1) Schema

Figure 1A:
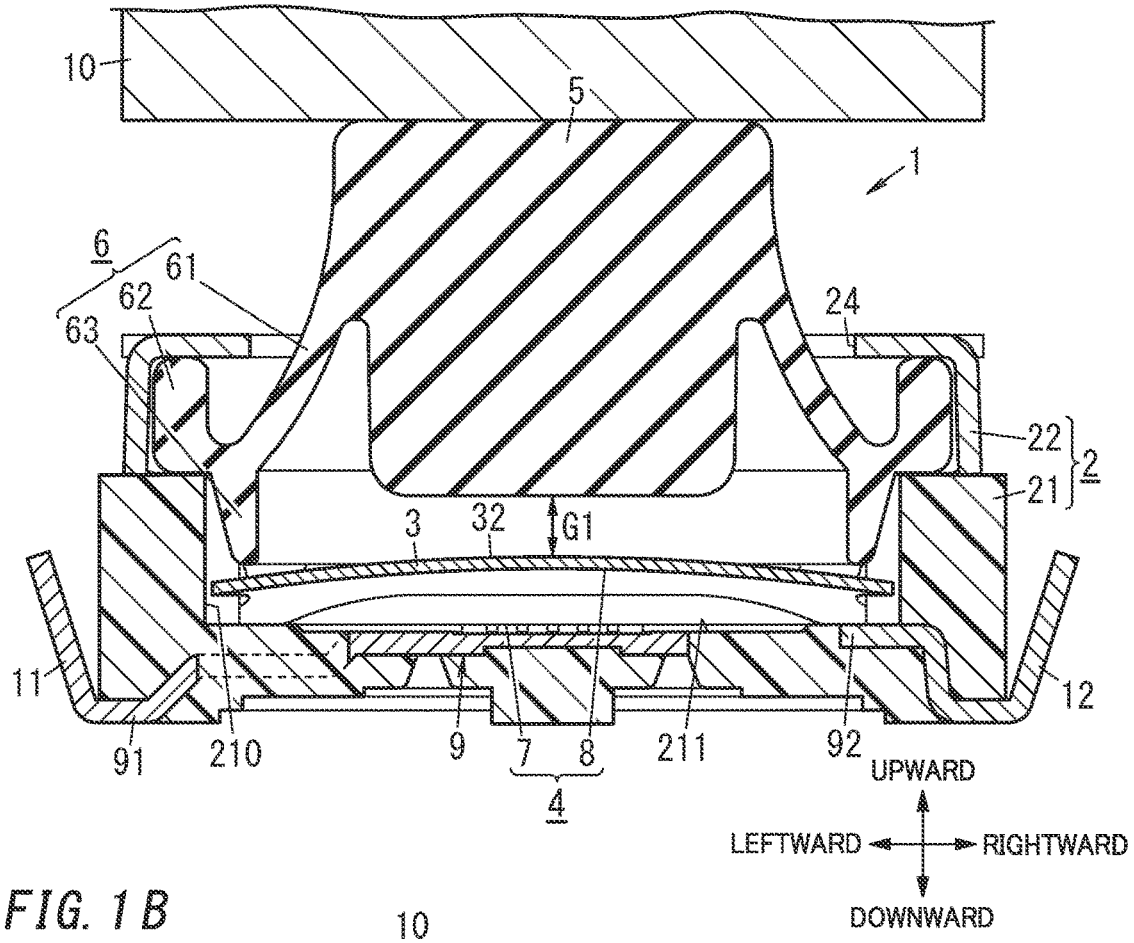
FIG. 1A is a cross sectional view schematically illustrating a push switch which is not operated according to one embodiment of the present disclosure.
Figure 1B:
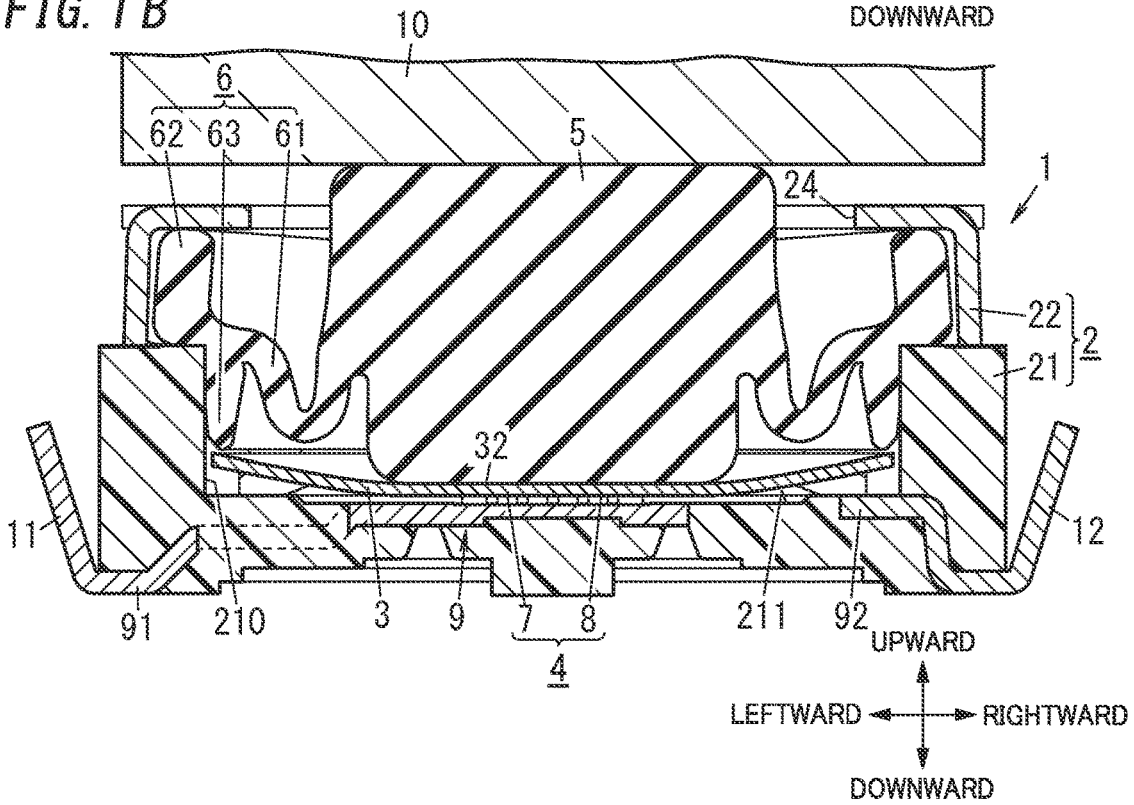
FIG. 1B is a cross sectional view schematically illustrating the push switch, which is operated.
Figure 2:
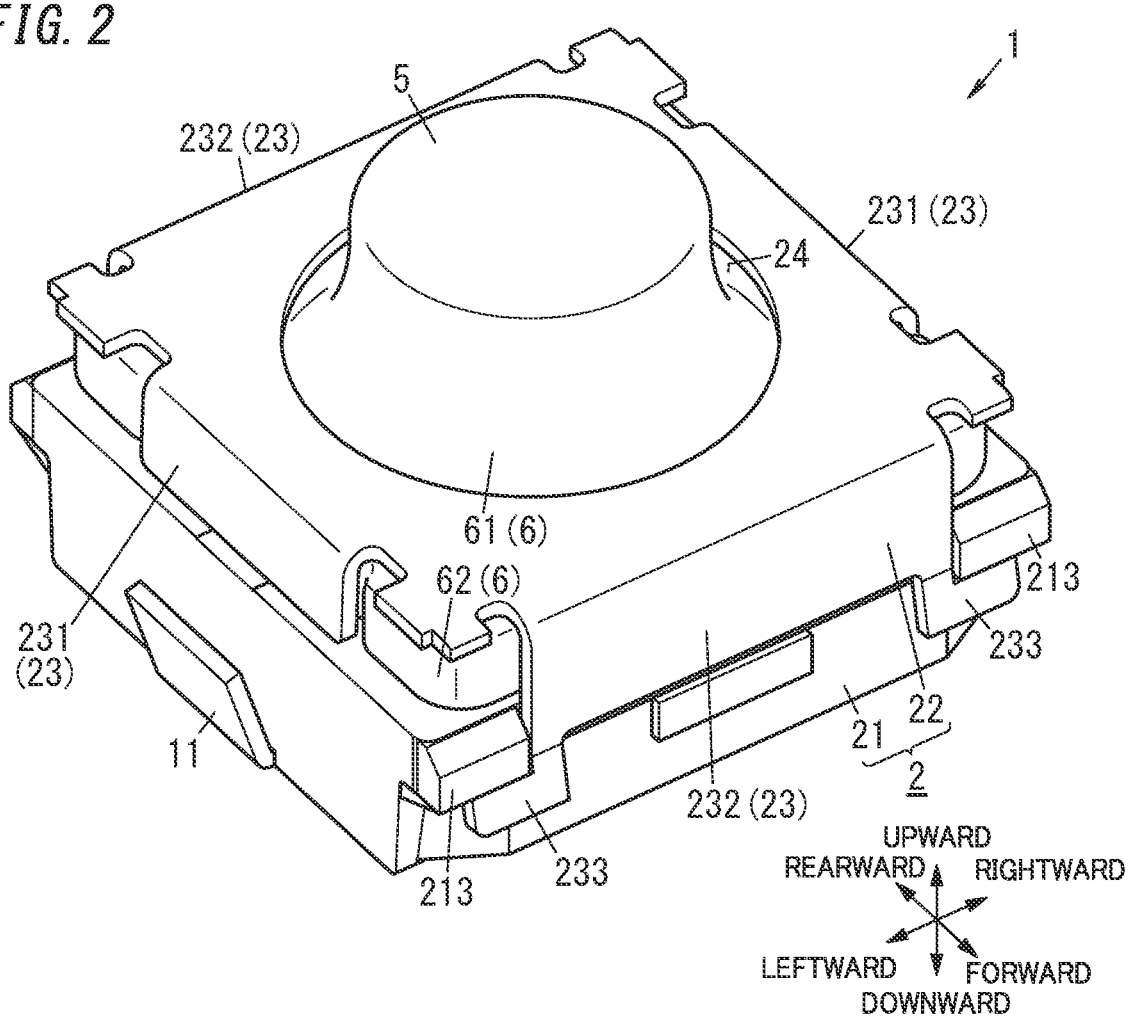
FIG. 2 is a perspective view illustrating the push switch.
Figure 3:
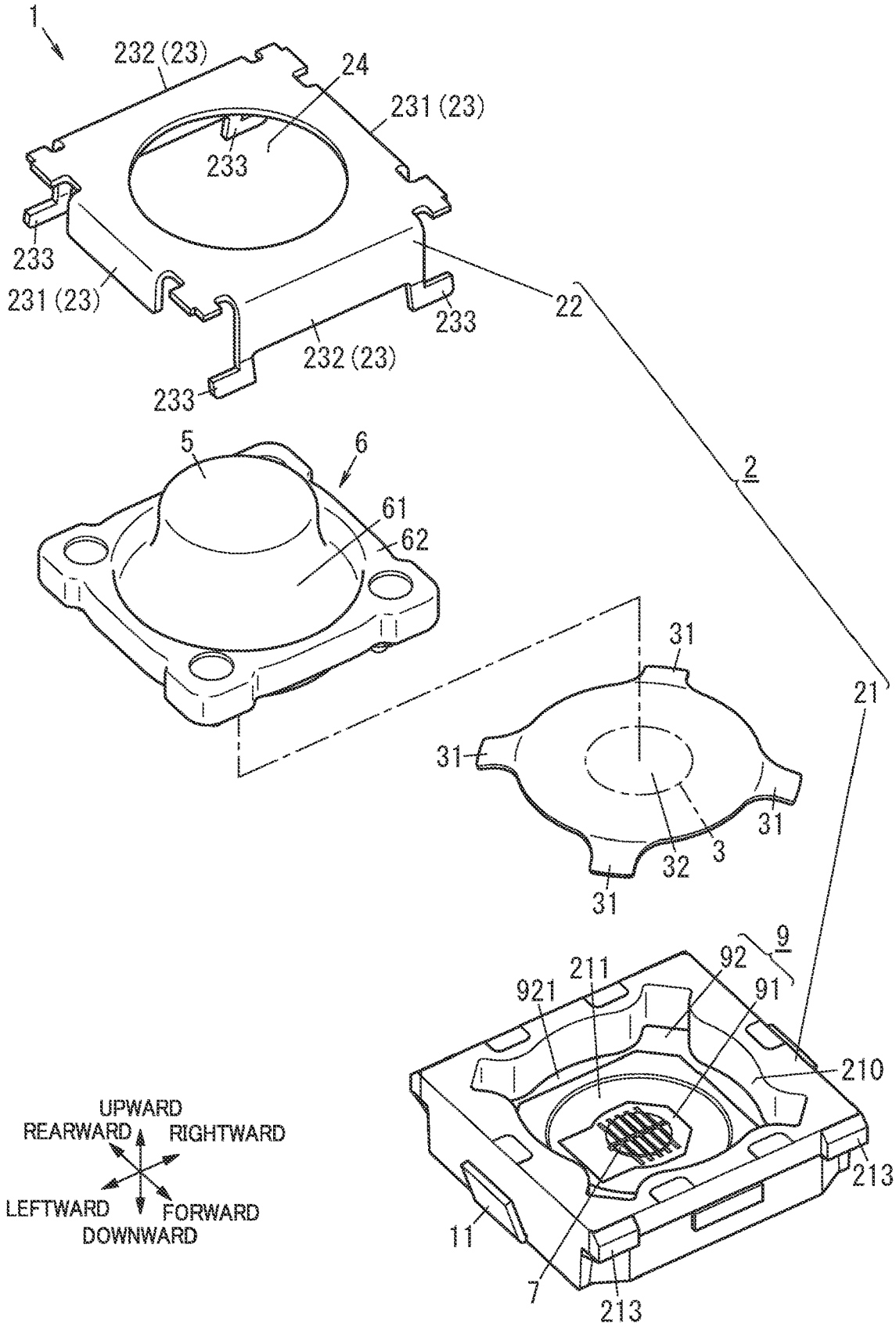
FIG. 3 is an exploded perspective view of the push switch.

As illustrated in FIGS. 1A and 1B, a push switch of the present embodiment includes a case 2 including a (first) fixed contact 7, a movable member 3, a pushing element 5, and a support 6.

The movable member 3 includes a movable contact 8. The movable member 3 is disposed at a location to face the fixed contact 7 and is movable between an ON-position at which the movable contact 8 is in contact with the fixed contact 7 and an OFF-position at which the movable contact 8 is apart from the fixed contact 7. The fixed contact 7 and the movable contact 8 constitute a contact device 4. The contact device 4 is ON when the movable contact 8 is at an ON-position, and the contact device 4 is OFF when the movable contact 8 is at an OFF-position.

The pushing element 5 is disposed at a location to face the movable member 3. Moreover, the pushing element 5 is configured to receive external force provided from outside the push switch 1 to push the movable member 3. The "external force" mentioned in the present disclosure is force applied from outside the push switch 1 to the push switch 1 when the push switch 1 is operated. In other words, the "external force" is force (hereinafter referred to as "operation force") applied by an operator of the push switch 1 to the pushing element 5. The operation force includes force applied to the pushing element 5 when the operator directly pushes the pushing element 5, and in addition, force applied to the pushing element 5 when the operator pushes the pushing element 5 via an intermediate member (e.g., an operation button 10).

The support 6 is integral with the pushing element 5. The support 6 is accommodated in the case 2 such that part of the support 6 is exposed outside the case 2.

The support 6 is continuous to the pushing element 5 and supports the pushing element 5 with respect to the case 2. In the present embodiment, the support 6 restricts the movement of the pushing element 5 within a flat plane orthogonal to the travel direction (an upward/downward direction which will be described later) of the pushing element 5 such that the relative location of the pushing element 5 to the movable member 3 in plan view does not change when the operation force is applied to the pushing element 5. As used herein, "in plan view" means that the pushing element 5 is viewed from above.

The push switch 1 is a normally OFF switch configured such that the contact device 4 is switched ON only when the push switch 1 is operated. To operate the push switch 1, a push operation is given to an upper end of the pushing element 5, thereby downward operation force acts on the pushing element 5. As used herein, the "push operation" is an operation of pushing the upper end of the pushing element 5 in a direction (downward) in which the push element 5 comes close to a bottom surface 211 of a recess 210.

Here, the support 6 is configured to perform a so-called invert action in accordance with the operation force applied to the pushing element 5 (the travel distance of the pushing element 5). Specifically, the support 6 has such a property that until the travel distance of the pushing element 5 reaches a first threshold Th1, a load applied from the support 6 to the pushing element 5 increases, and when the travel distance of the pushing element 5 reaches the first threshold Th1, the load applied from the support 6 to the pushing element 5 decreases (see FIG. 7B). As used herein the "travel distance of the pushing element" refers to a distance from the location of the pushing element 5 in a non-operational state to a location of the pushing element 5 after the operation force is applied to the pushing element 5 and the pushing element 5 is thus moved. In the present embodiment, the travel distance of the pushing element 5 required to switch the push switch 1 from OFF to ON is, for example, approximately 1 to several millimeters.

Moreover, the movable member 3 is configured to perform a so-called invert action in accordance with operation force applied to the pushing element 5 (the travel distance of the pushing element 5). Specifically, the movable member 3 has such a property that until the travel distance of the pushing element 5 reaches a second threshold Th2, a load applied from the movable member 3 to the pushing element 5 increases, and when the travel distance of the pushing element 5 reaches the second threshold Th2, the load applied from the movable member 3 to the pushing element 5 decreases (see solid line in FIG. 7C).

Here, comfortableness (click feeling) is provided to an operator as the movable member 3 deforms. However, depending on the load applied from the support 6 to the pushing element 5 at the time of the invert action of the movable member 3, the comfortableness given to the operator may be impaired. In contrast, in the present embodiment, as described above, not only the movable member 3 performs the invert action, but also the support 6 performs the invert action. Therefore, in the present embodiment, the load applied from the support 6 to the pushing element 5 at the time of the invert action of the movable member 3 is reduced as compared to a case where the support 6 does not perform the invert action. As a result, the present embodiment has the advantage that when the operator gives a push operation to the pushing element 5, the comfortableness provided to the operator is less likely to be impaired.

(2) Details

The push switch 1 of the present embodiment will be described in detail below. The push switch 1 is used, for example, in an operation section of a various types of apparatuses such as portable information terminals, in-vehicle apparatuses, and household appliances. The push switch 1 is accommodated in a housing of an apparatus in a state where the push switch 1 is mounted on, for example, a printed circuit board. In this case, in the housing, at a location corresponding to the push switch 1, for example, an operation button 10 as an intermediate member is disposed. Thus, an operator pushes the operation button 10, thereby indirectly operate the push switch 1 via the operation button 10.

In the following description, a surface of the case 2 in which the recess 210 is formed is referred to as an upper surface of the case 2, and the depth direction of the recess 210 is referred to as an "upward/downward direction" unless otherwise indicated. Moreover, in the following description, a direction in which a first terminal 11 and a second terminal 12 which will be described later protrude from the case 2 is referred to as a "rightward/leftward direction", and a direction orthogonal to both the upward/downward direction and the rightward/leftward direction (a direction orthogonal to the sheet surface of FIG. 1A) is a "forward/rearward direction". That is, "upward", "downward", "left", "right", "forward", and "rearward" arrows illustrated in FIG. 1A or the like represent in a straightforward manner the upward, downward, left, right, forward and rearward directions, respectively. However, there is no intent to use these directions to limit directions of the push switch 1 in use. Additionally, the arrows representing the directions in figures are described only for facilitating understanding and are intangible.

As illustrated in FIGS. 1A to 3, the push switch 1 includes the case 2, the movable member 3, the contact device 4, the pushing element 5, the support 6, and a metal body 9. An example in which the push switch 1 is not operated, that is, the push switch 1 is not pushed will be described below unless otherwise indicated.

The case 2 includes a body 21 and a cover 22. The body 21 is made of a synthetic resin and is electrically insulating. The body 21 is in the shape of a rectangular parallelepiped. The body 21 has an upper surface in which the recess 210 having a circular shape in plan view is formed. The center of the recess 210 coincides with the center of the upper surface of the body 21. The body 21 has a shape with its four corners beveled in plan view. However, beveling is not essential for the push switch 1 and may accordingly be omitted.

Figure 4:
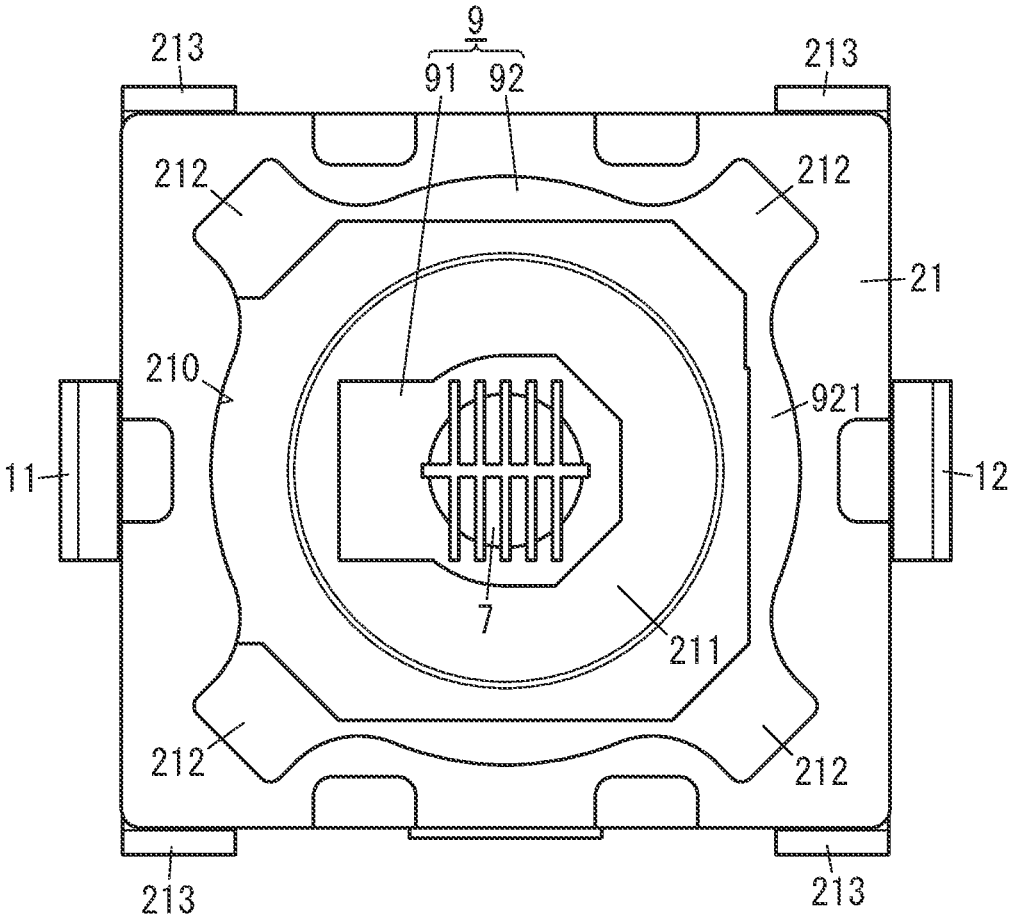
FIG. 4 is a plan view illustrating the push switch with a pushing element, a movable member, and a cover being removed.

The bottom surface 211 of the recess 210 has an outer periphery at which a contact portion 212 for the movable member 3 is provided (see FIG. 4). The contact portion 212 is an area which is part of the bottom surface 211 of the recess 210 and with which the movable member 3 comes into contact. In the present embodiment, the movable member 3 comes into contact with the bottom surface 211 of the recess 210 at a plurality of sites (in this embodiment, four sites). Thus, the body 21 has a plurality of (in this embodiment, four) contact portions 212. The four contact portions 212 are arranged at four corners of the bottom surface 211 of the recess 210.

The cover 22 is made of metal and has a rectangular shape in plan view. The cover 22 has four sides provided with respective projection pieces 23 each of which protrudes downward and which is rectangular. Of the four projection pieces 23, two first projection pieces 231 (in this embodiment, the projection pieces 23 on both sides of the cover 22 in the rightward/leftward direction) restrict movement of the support 6 in the rightward/leftward direction in a state where the pushing element 5 is accommodated in the case 2. Moreover, of the four projection pieces 23, the remaining two projection pieces, that is, second projection pieces 232 (in this embodiment, the projection pieces 23 on both sides of the cover 22 in the forward/rearward direction) each have a pair of hooking pawls 233. The pairs of hooking pawls 233 of the two second projection pieces 232 are hooked on respective pairs of projection portions 213 provided on a front surface and a rear surface of the body 21, thereby coupling the body 21 and the cover 22 to each other. The cover 22 has a central part in which a through hole 24 is formed. The through hole 24 has a circular shape in plan view. The upper end of the pushing element 5 passes through the through hole 24. Thus, the pushing element 5 is accommodated in the case 2 such that the upper end of the push element 5 is exposed outside through the through hole 24.

The metal body 9 includes a first metal member 91 and a second metal member 92. The first metal member 91 and the second metal member 92 are formed from a metal plate having conductive properties and are held by the body 21. In the present embodiment, the first metal member 91 and the second metal member 92 are integrally formed with the body 21 by insert molding. That is, the body 21 is insert molded with the metal body 9 (the first metal member 91 and the second metal member 92) being as an insert product.

The first metal member 91 includes the (first) fixed contact 7 and the first terminal 11. The fixed contact 7 includes an area protruding upward from an upper surface of the first metal member 91 and having a circular shape in plan view. The second metal member 92 includes a (second) fixed contact 921 and the second terminal 12. The fixed contact 7 and the fixed contact 921 are exposed from the bottom surface 211 of the recess 210. The fixed contact 7 is exposed at the central part of the recess 210. The fixed contact 921 is exposed at an outer periphery of the recess 210. The fixed contact 7 protrudes upward from the bottom surface 211 of the recess 210. An area of the first metal member 91 around the fixed contact 7 and the fixed contact 921 are substantially flush with the bottom surface 211.

The first terminal 11 and the second terminal 12 protrudes from both surfaces in the rightward/leftward direction of the body 21. Specifically, the first terminal 11 protrudes leftward from the left side surface of the body 21. The second terminal 12 protrudes rightward from the right side surface of the body 21. The first terminal 11 and the second terminal 12 are mechanically coupled and electrically connected to, for example, a conductive member on the printed circuit board with solder.

The fixed contact 7 and the first terminal 11 are electrically connected to each other via a portion which is part of the first metal member 91 and which is embedded in the body 21. Similarly, the fixed contact 921 and the second terminal 12 are electrically connected to each other via a portion which is part of the second metal member 92 and which is embedded in the body 21. The first metal member 91 and the second metal member 92 are electrically insulated from each other.

The movable member 3 is made of metal and is disposed in the recess 210 formed in the body 21. In the present embodiment, the movable member 3 is formed from an elastic plate material, such as, a metal plate made of, for example, stainless steel (SUS). In the present embodiment, the movable member 3 is one sheet of leaf spring. The movable member 3 has a shape (circular shape) corresponding to the recess 210 and is slightly smaller than the recess 210 so that the movable member 3 can be within the recess 210. The movable member 3 has an upper surface whose central part is a pressure receiving part 32 (see FIG. 3). That is, the central part of the upper surface of the movable member 3 functions as the pressure receiving part 32 configured to receive operation force.

The central part of the movable member 3 has an upwardly protruding curved dome shape. That is, in the present embodiment, the movable member 3 is a dome formed from a conductive metal plate. The movable member 3 has an outer peripheral edge at which four contact pieces 31 are provided at intervals in the peripheral direction thereof. In a state where the movable member 3 is stored in the recess 210, the contact pieces 31 are in contact with the bottom surface 211 of the recess 210. That is, the movable member 3 comes into contact with the contact portions 212 on the bottom surface 211 of the recess 210 at four sites. Alternatively, the movable member 3 may come into contact with the bottom surface 211 at sites other than these four sites.

A portion of the movable member 3 corresponding to the central part (the pressure receiving part 32) constitutes the movable contact 8. The movable member 3 is electrically connected to the fixed contact 921 exposed at the bottom surface 211 at least at the four sites (the four contact pieces 31) that is in contact with the contact portions 212 on the bottom surface 211. The movable member 3 has a lower surface on the entirety of which a conductive film having a conductive property is desirably formed by, for example, gold (Au) plating or silver (Ag) plating.

Moreover, when operation force acts on the pressure receiving part 32, the movable member 3 deforms, and the movable member 3 thus warps downward, which will be specifically described in "(3) Operation". For example, the movable member 3 deforms such that the central part of the movable member 3 has a downwardly protruding dome shape as illustrated in FIG. 1B. That is, the movable member 3 is configured to perform a so-called invert action in accordance with the operation force applied to the pushing element 5 (the travel distance of the pushing element 5). In the present embodiment, an increase or decrease in the load applied from the movable member 3 to the pushing element 5 is inverted at the second threshold Th2 (here, 0.8 (mm)) as the border (see the solid line in FIG. 7C). At this time, the movable contact 8 formed at a lower surface of the pressure receiving part 32 comes into contact with the fixed contact 7, and thereby, the movable contact 8 and the fixed contact 7 are electrically connected to each other.

That is, the movable contact 8 and the fixed contact 7 constitute the contact device 4. The pressure receiving part 32 is pushed in a direction (downward) to come close to the bottom surface 211 of the recess 210 to deform the movable member 3, and thereby, the contact device 4 is switched ON and OFF. Specifically, in a state where no operation force is exerted on the pressure receiving part 32, the movable contact 8 is apart from the fixed contact 7, and therefore, the contact device 4 is OFF. At this time, the first metal member 91 and the second metal member 92 are electrically insulated from each other, and thus, the first terminal 11 and the second terminal 12 is not electrically connected. In contrast, when the operation force is applied to the pressure receiving part 32, and the movable contact 8 thus comes into contact with the fixed contact 7, the contact device 4 is switched ON. At this time, the first metal member 91 and the second metal member 92 are electrically connected to each other via the movable member 3, and therefore the first terminal 11 and the second terminal 12 is electrically connected.

The pushing element 5 is made of rubber and is electrically insulating. The pushing element 5 has a cylindrical shape with its axis extending in the upward/downward direction. The pushing element 5 is disposed above the movable member 3 to face the pressure receiving part 32 of the movable member 3. In the present embodiment, in anon-operational state, the pushing element 5 and the movable member 3 are not in contact with each other, and a gap G1 is provided between a lower surface of the pushing element 5 and the pressure receiving part 32 of the movable member 3 (see FIG. 1A). In other words, between the pushing element 5 and the movable member 3, the gap G1 is formed in a state where no operation force (external force) is applied.

The pushing element 5 transmits the operation force applied to the upper end to the pressure receiving part 32 of the movable member 3. That is, when the operation force acts, from above, on the upper end of the pushing element 5, the operation force is transmitted via the pushing element 5 to the pressure receiving part 32 and acts on the pressure receiving part 32 from above. Thus, pushing the pushing element 5 indirectly operates the pressure receiving part 32 via the pushing element 5.

Figure 5A:
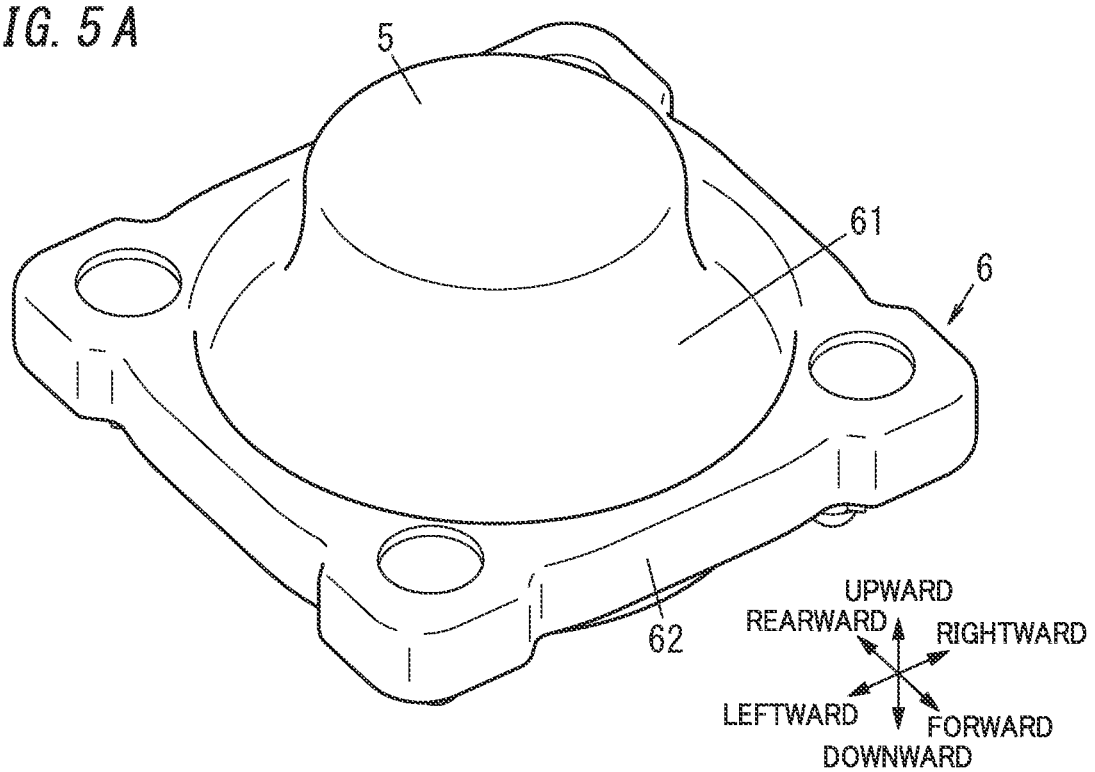
FIG. 5A is a top perspective view illustrating the pushing element and a support of the push switch.
Figure 5B:
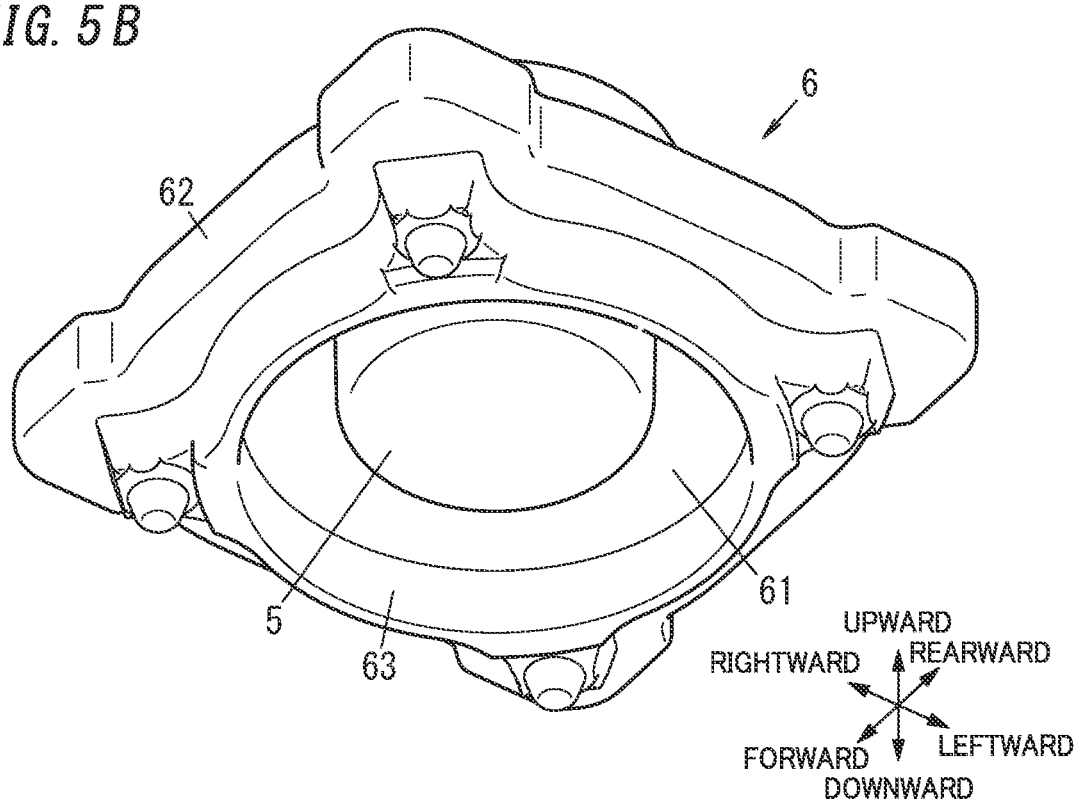
FIG. 5B is a bottom perspective view illustrating the pushing element and the support of the push switch.

The support 6 is made of, for example, rubber and includes a main part 61, abase part 62, and an extension part 63 as illustrated in FIGS. 5A and 5B. The main part 61 has a hollow circular truncated cone shape. The main part 61 has an upper edge integral with an intermediate portion of a side surface of the pushing element 5 in the upward/downward direction. That is, in the present embodiment, the pushing element 5 and the support 6 are integral with each other and are made of rubber. The main part 61 has an outer side surface which is formed to have a smooth curved line along the upward/downward direction in sectional view. That is, main part 61 has a circular truncated cone shape which has an inwardly narrowing outer side surface as comparted to an outer side surface of a general circular truncated cone having a diameter dimension increasing at a constant ratio. The main part 61 has the same thickness over the entire longitudinal direction (upward/downward direction). Integration of the pushing element 5 is performed by connecting the side surface of the pushing element 5 to the upper edge of the main part 61. The pushing element 5 has a solid columnar, preferably solid cylindrical, shape having the same size (diameter) over the upward/downward direction. The base part 62 is integral with a lower edge of the main part 61 and has a rectangular frame shape. The base part 62 is placed on the upper surface of the body 21. In a state where the base part 62 is placed on the upper surface of the body 21, the entirety of an upper surface of the base part 62 is located at substantially the same height. The upper surface of the base part 62 has an outer peripheral edge which has a beveled part. The beveled part is desirably, but is not limited to be, a rounded shape. The extension part 63 is integral with the lower edge of the main part 61 and has a cylindrical shape extending downward. The extension part 63 is inserted in the recess 210 of the body 21 and faces an inner side wall of the recess 210. The extension part 63 has a diameter dimension smaller than the width dimension (the dimension in the rightward-leftward direction or forward/rearward direction) of the base part 62. As described above, the support 6 has a configuration in which the upper edge of the main part 61 having a circular truncated cone shape is connected to the side surface of the pushing element 5, and the lower edge of the main part 61 is connected to the base part 62. In this configuration, the support 6 which performs the invert action may be disposed in a small projection area when viewed from above (in other words, such that an area for the support 6 when viewed from above is relatively small), and the outer shape of the push switch 1 is suppressed from increasing.

The base part 62 of the support 6 is sandwiched between the upper surface of the body 21 and an inner surface of the cover 22, and thereby, the location of the base part 62 is defined in the case 2. Here, the base part 62 is not firmly fixed in the case 2 but is allowed to slightly move in a space formed between the upper surface of the body 21 and the inner surface of the cover 22. As described above, the base part 62 is held in the case 2, and thereby, the support 6 and the pushing element 5 integral with the support 6 are held by the case 2. In other words, the support 6 supports the pushing element 5 with respect to the case 2.

Here, the support 6 is configured to perform the invert action in accordance with operation force applied to the pushing element 5 (the travel distance of the pushing element 5). The invert action of the support 6 will be described below with reference to FIGS. 6A to 6F.

Figure 6A:
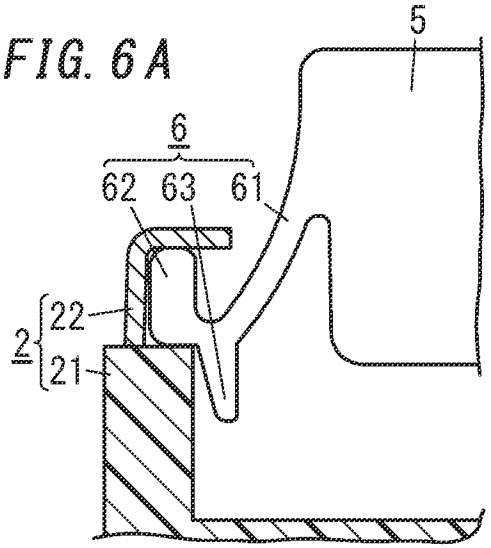
FIGS. 6A to 6F are sectional views of a main part illustrating the behavior of the support of the push switch.
Figure 6B:
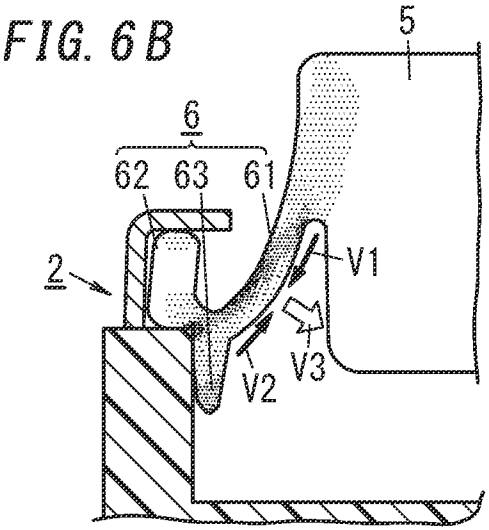
Figure 6C:
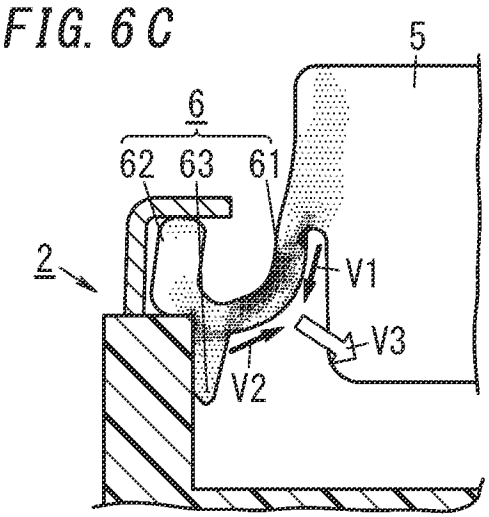
Figure 6D:
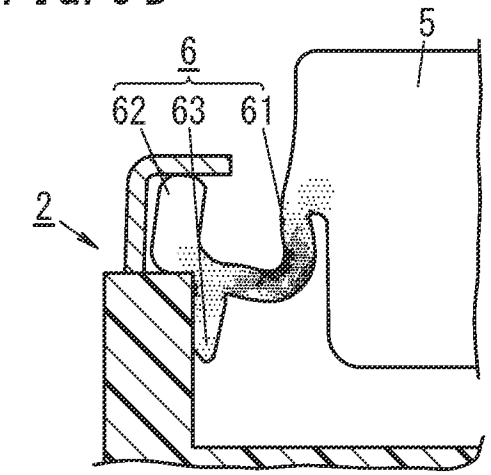
Figure 6E:
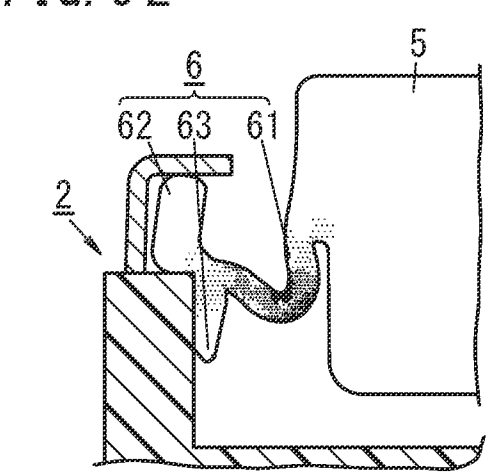
Figure 6F:
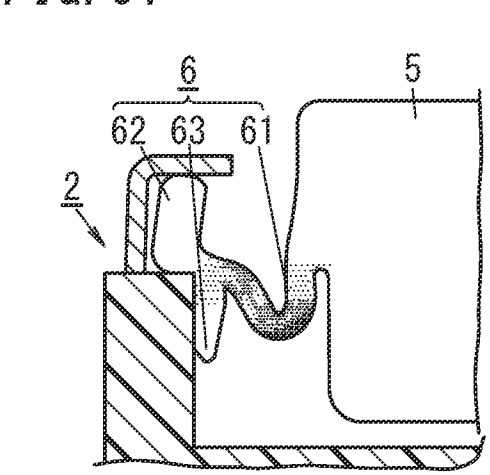

FIGS. 6A to 6F show behavior of the support 6 according to the travel distance of the pushing element 5 in the push switch 1, with the movable member 3 being removed. FIG. 6A shows a state of the support 6 in a non-operational state, that is, the travel distance of the pushing element 5 is zero. FIGS. 6B to 6F show the support 6 with the travel distance of the pushing element 5 is 0.2 (mm), 0.4 (mm), 0.6 (mm), 0.8 (mm), and 1.0 (mm) respectively. Moreover, in each of FIGS. 6A to 6F, a portion on which the load is applied is indicated by dots. As the density of the dots increases, the magnitude of the load increases, and the density of the dots decreases, the magnitude of the load decreases.

In the support 6, until the travel distance of the pushing element 5 reaches the first threshold Th1 (in this embodiment, 0.6 (mm)), the main part 61 receives the operation force and gradually deforms (see FIGS. 6A to 6C), but the main part 61 still has the function of transmitting the operation force to the extension part 63. Thus, until the travel distance of the pushing element 5 reaches the first threshold Th1, resistance force that the extension part 63 receives from the case 2 is transmitted via the main part 61 to the pushing element 5. Therefore, until the travel distance of the pushing element 5 reaches the first threshold Th1, the load applied from the support 6 to the pushing element 5 increases as the travel distance of the pushing element 5 increases.

Here, force (composition vector V3) in a direction orthogonal to the surface of the main part 61 corresponds to the sum of force (first vector V1) transmitted from the pushing element 5 to the case 2 and resistance force (second vector V2) transmitted from the case 2 to the pushing element 5. As the travel distance of the pushing element 5 increases, the main part 61 gradually deforms, so that the composition vector V3 becomes large. Then, the size of the composite vector V3 exceeds a prescribed value. At that time, the balance between the first vector V1 and the second vector V2 is lost, and the main part 61 excessively deforms as compared to a case of the non-operational state (see FIGS. 6D to 6F). Hereafter, in the support 6, the main part 61 has no longer the function of transmitting the operation force to the extension part 63. As described above, when the support 6 has a shape including the extension part 63, movement of the extension part 63 is restricted by the inner side wall of the recess 210. Thus, the intermediate portion in a longitudinal direction of the main part 61 enters the recess 210 and is located at a lower level than the lower surface of the base part 62.

That is, in the support 6, after the travel distance of the pushing element 5 reaches the first threshold Th1, the resistance force from the case 2 is hardly transmitted via the main part 61 to the pushing element 5. Thus, after the travel distance of the pushing element 5 reaches the first threshold Th1, the load applied from the support 6 to the pushing element 5 decreases as the travel distance of the pushing element 5 increases. That is, in the present embodiment, the increase and decrease in the load applied from the support 6 to the pushing element 5 is inverted at the first threshold Th1 as the border. Moreover, in the present embodiment, the first threshold Th1 is smaller than the second threshold Th2. Thus, in the present embodiment, the support 6 is configured to perform the invert action before the movable member 3 performs the invert action.

As described above, the support 6 performs the invert action of the main part 61 in accordance with the downward movement of the pushing element 5. The main part 61 preferably has a shape whose diameter increases downward from above to in sectional view. The length, thickness, and inclined angle of the main part 61 are accordingly set, thereby obtaining a desired invert action of the main part 61. Moreover, the main part 61 has a circular truncated cone shape which has an inwardly narrowing outer side surface as comparted to an outer side surface of a general circular truncated cone as described above. In this case, the curvature of the outer side surface, the curvature of the inner side surface on an opposite side of the outer side surface, and the like are desirably accordingly set in accordance with the properties of the desired invert action.

(3) Operation

The operation of the push switch 1 of the present embodiment will be described below.

(3.1) Basic Operation

First, the basic operation of the push switch 1 will be described with reference to FIGS. 1A and 1B. When an operator gives a push operation with force greater than or equal to a certain level to the pushing element 5 of the push switch 1, operation force is applied to the pressure receiving part 32 of the movable member 3 from above via the pushing element 5. Then, the pressure receiving part 32 is pushed downward, and the movable member 3 gradually deforms. When the magnitude of the operation force acting on the movable member 3 exceeds a prescribed magnitude (in other words, when the travel distance of the pushing element 5 exceeds the second threshold Th2), the movable member 3 rapidly buckles and largely deforms as illustrated in FIG. 1B. At that time, the resilient force of the movable member 3 that acts on the pressure receiving part 32 rapidly changes. Due to such an invert action of the movable member 3, the movable member 3 deforms such that the central part (the pressure receiving part 32) has a downwardly protruding curved dome shape as illustrated in, for example, FIG. 1B. Thus, as the movable member 3 deforms, comfortableness (click feeling) is provided to the operator who gives a push operation to the push switch 1. When the movable member 3 deforms as described above, as illustrated in FIG. 1B, the movable contact 8 formed at the lower surface of the movable member 3 comes into contact with the fixed contact 7, and the contact device 4 is switched ON. In this state, the region between the first terminal 11 and the second terminal 12 are electrically connected to each other.

In contrast, in a state where the movable member 3 is deformed as described above, when the operation force no longer acts on the pressure receiving part 32, the central part (the pressure receiving part 32) of the movable member 3 is restored (deforms) to have an upwardly protruding curved dome shape by restoring force of the movable member 3. At that time, the resilient force of the movable member 3 acting on the pressure receiving part 32 rapidly changes, and therefore, the movable member 3 is rapidly restored (deforms) to have its original shape. When the movable member 3 returns to the original shape, as illustrated in FIG. 1A, the movable contact 8 formed at the lower surface of the movable member 3 is apart from the fixed contact 7, and the contact device 4 is switched OFF. In this state, the first terminal 11 and the second terminal 12 is not electrically connected to each other.

(3.2) As to Load Acting on Operator

Next, the load that acts on the operator when the operator gives a push operation to the pushing element 5 of the push switch 1 will be described with reference to FIGS. 7A to 7D. In the push switch 1 of the present embodiment, the correlation between the load applied from the pushing element 5 to the operator and the travel distance of the pushing element 5 shows different characteristics in a first area A1, a second area A2, and a third area A3 as illustrated in FIG. 7A. In each of FIGS. 7A to 7D, the ordinate represents the load (unit: N), and the abscissa represents the travel distance (unit: mm) of the pushing element 5.

FIG. 7A is a correlation diagram between the load applied from the pushing element 5 to the operator and the travel distance of the pushing element 5. FIG. 7B is a correlation diagram between a load applied from the support 6 via the pushing element 5 to the operator and the travel distance of the pushing element 5. FIG. 7C is a correlation diagram between a load (see the solid line) applied from the movable member 3 via the pushing element 5 to the operator and the travel distance of the pushing element 5 in the second area A2. Note that the broken line in FIG. 7C represents the correlation between the travel distance of the pushing element 5 and a load which is part of the load applied from the movable member 3 via the pushing element 5 to the operator and to which the pushing element 5 contributes. Moreover, the long dashed short dashed line in FIG. 7C represents the correlation between the travel distance of the pushing element 5 and a load which is part of the load applied from the movable member 3 via the pushing element 5 to the operator and to which the movable member 3 contributes. FIG. 7D is a correlation diagram between the load applied from the pushing element 5 to the operator and the travel distance of the pushing element 5 in the third area A3.

The first area A1 is an area from when the operation force acts on the upper end of the pushing element 5 to when the lower end of the pushing element 5 comes into contact with the pressure receiving part 32 of the movable member 3. In the first area A1, the operation force acts on the upper end of the pushing element 5, and thereby, the pushing element 5 is pushed downward, and the support 6 thus gradually deforms. As described above, the gap G1 is provided between the pushing element 5 and the movable member 3 in the non-operational state. Thus, until the pushing element 5 comes into contact with the pressure receiving part 32 of the movable member 3, that is, until the pushing element 5 moves by a distance corresponding to the height of the gap G1, the load acting on the operator corresponds to the load applied from the support 6 via the pushing element 5 to the operator. As illustrated in FIGS. 7A and 7B, the travel distance of the pushing element 5 does not reach the first threshold Th1 in the first area A1, and therefore, the load applied from the support 6 via the pushing element 5 to the operator increases as the travel distance of the pushing element 5 increases.

The second area A2 is an area from when the lower end of the pushing element 5 comes into contact with the pressure receiving part 32 of the movable member 3 to when the movable member 3 deforms and the contact device 4 is thus switched ON. In the second area A2, the operation force acts on the movable member 3 via the pushing element 5, and thereby, the movable member 3 is pushed downward, and the movable member 3 thus gradually deforms. Thus, in the second area A2, the load acting on the operator corresponds to the sum of the load applied from the support 6 via the pushing element 5 to the operator and the load applied from the movable member 3 via the pushing element 5 to the operator.

Here, as illustrated in FIG. 7B, the invert action of the support 6 is not performed until the travel distance of the pushing element 5 reaches the first threshold Th1, and therefore, the load applied from the support 6 via the pushing element 5 to the operator increases as the travel distance of the pushing element 5 increases. In contrast, the invert action of the support 6 is performed when the travel distance of the pushing element 5 reaches the first threshold Th1, and therefore, the load applied from the support 6 via the pushing element 5 to the operator hereafter decreases as the travel distance of the pushing element 5 increases.

Moreover, as illustrated in FIG. 7C, the invert action of the movable member 3 is not performed until the travel distance of the pushing element 5 reaches the second threshold Th2, and therefore, the load applied from the movable member 3 via the pushing element 5 to the operator increases as the travel distance of the pushing element 5 increases. In contrast, when the travel distance of the pushing element 5 reaches the second threshold Th2, the invert action of the movable member 3 is performed, and thereby, the load applied from the movable member 3 via the pushing element 5 to the operator rapidly decreases.

Thus, as illustrated in FIG. 7A, in the second area A2, the load acting on the operator increases as the travel distance of the pushing element 5 increases until the travel distance of the pushing element 5 reaches the second threshold Th2. After the travel distance of the pushing element 5 reaches the second threshold Th2, the load acting on the operator rapidly decreases.

Here, in the second area A2, the magnitude of a difference B between a maximum value (hereinafter also referred to as a "peak load") and a minimum value (hereinafter also referred to as a"bottom load") of the load acting on the operator during the push operation influences the comfortableness (click feeling) provided to the operator. Specifically, as the difference B1 between the peak load and the bottom load in the second area A2 increases, the comfortableness is improved. Moreover, as the gradient from the peak load to the bottom load in the second area A2 increases, the comfortableness is improved. In the present embodiment, the pushing element 5 is made of rubber and is softer than the movable member 3 made of metal. That is, in the present embodiment, the elastic modulus of the pushing element 5 is smaller than the elastic modulus of the movable member 3. Thus, in the present embodiment, the gradient from the peak load to the bottom load in the second area A2 increases as compared to a case where the movable member 3 is pushed by an item made of a material harder than the pushing element 5. As a result, the comfortableness (click feeling) provided to the operator is improved.

The third area A3 is an area from when the contact device 4 is switched ON and the pushing element 5 is further pushed. In the third area A3, the movable contact 8 of the movable member 3 is in contact with the fixed contact 7, and downward movement of the movable member 3 is thus restricted. Therefore, in the third area A3, the operation force acts on the upper end of the pushing element 5, and the pushing element 5 gradually deforms to be crushed between the operation button 10 and the movable member 3. In the third area A3, the load acting on the operator corresponds to the sum of the load applied from the support 6 via the pushing element 5 to the operator, the load applied from the movable member 3 via the pushing element 5 to the operator, and the load applied from the pushing element 5 to the operator. Thus, as illustrated in FIG. 7D, in the third area A3, the load acting on the operator increases as the travel distance of the pushing element 5 increases.

As described above, in the present embodiment, not only the movable member 3 performs the invert action, but also the support 6 performs the invert action. Therefore, in the present embodiment, the load applied from the support 6 to the pushing element 5 at the time of the invert action of the movable member 3 is reduced as compared to a case where the support 6 does not perform the invert action. As a result, the present embodiment has the advantage that when the operator gives a push operation to the pushing element 5, the comfortableness provided to the operator is less likely to be impaired.

Figure 8A:
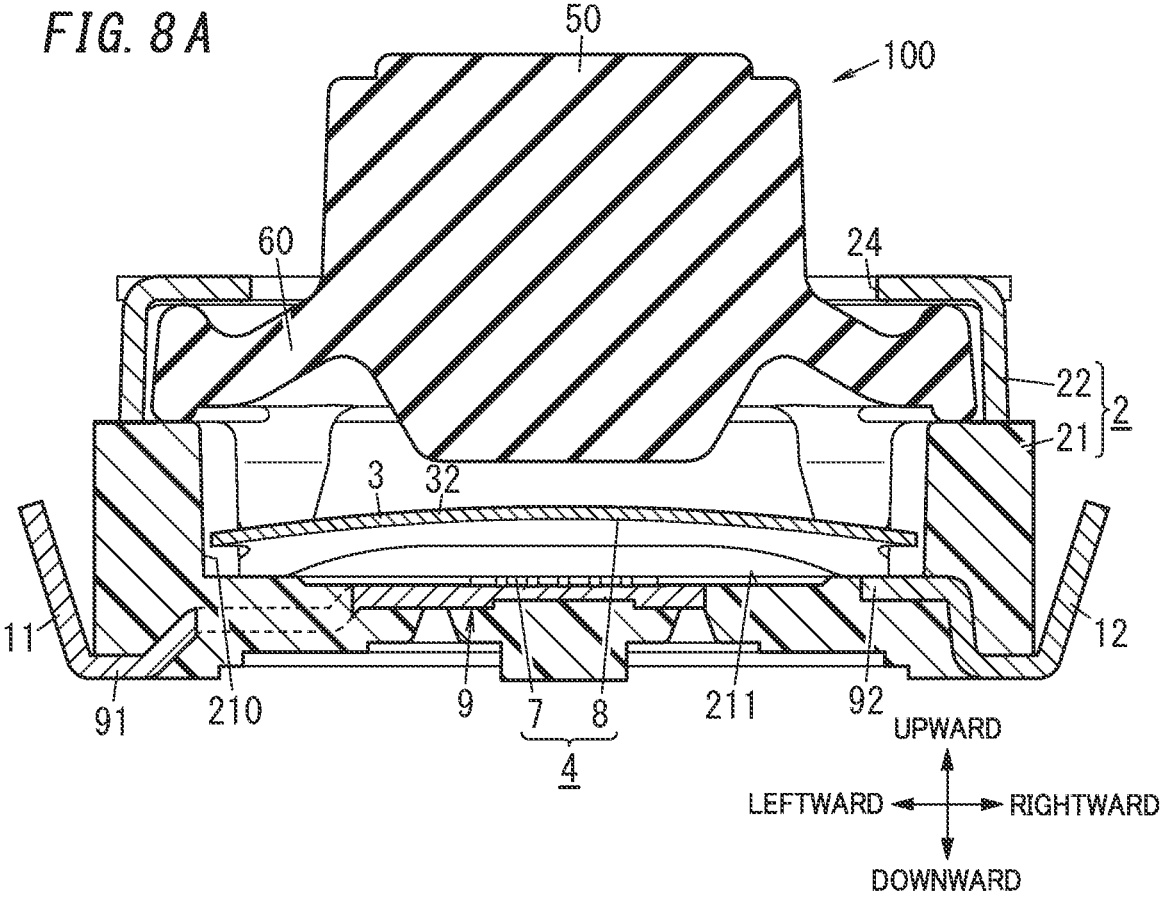
FIG. 8A is a cross sectional view schematically illustrating a push switch of a comparative example, where the push switch is not operated.
Figure 8B:
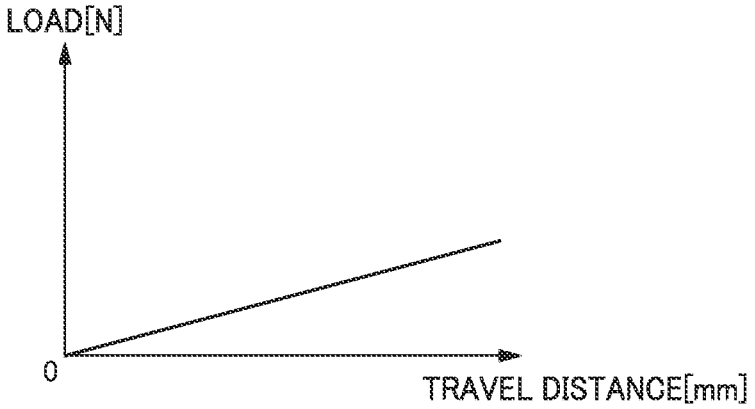
FIG. 8B is a correlation diagram between the travel distance of a pushing element in the push switch of the comparative example and a load applied from a support to the pushing element.

The advantage will be described below in comparison with a push switch 100 of a comparative example. The push switch 100 of the comparative example is different from the push switch 1 of the embodiment in that a pushing element 50 and a support 60 are provided in place of the pushing element 5 and the support 6 respectively as illustrated in FIG. 8A. The pushing element 50 is substantially the same as the pushing element 5 except that a lower end of the pushing element 50 is tapered narrower than the lower end of the pushing element 5. The support 60 is different from the support 6 in shape and performs no invert action. That is, in the push switch 100 of the comparative example, a load applied from the support 60 via the pushing element 50 to an operator increases as the travel distance of the pushing element 50 increases, and the load does not transition to a decrease during the operation as illustrated in FIG. 8B. Note that in FIG. 8B, the ordinate represents the load (unit: N), and the abscissa represents the travel distance (unit: mm) of the pushing element 50. The same applies to FIGS. 9, 10A, and 10B which will be described later.

Figure 9:
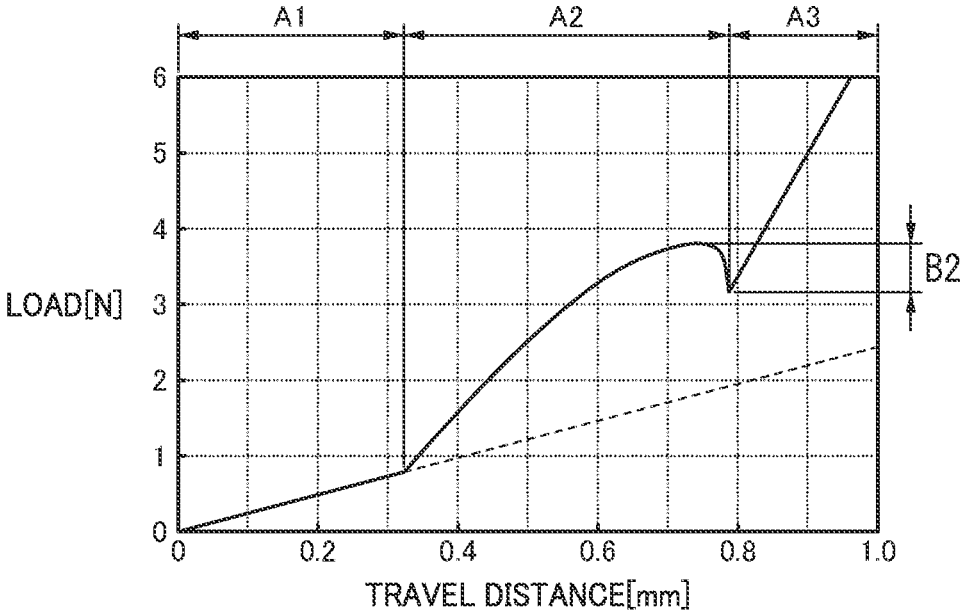
FIG. 9 is a correlation diagram between the travel distance of the pushing element in the push switch of the comparative example when a movable member of the comparative example is used and a load applied from the pushing element to an operator.
Figure 10A:
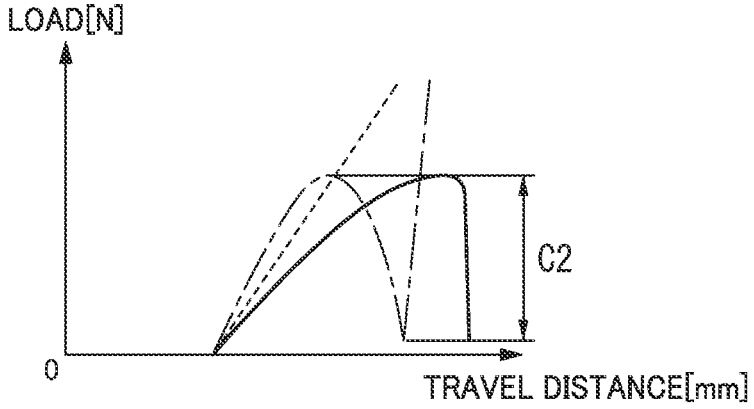
FIG. 10A is a correlation diagram between the travel distance of the pushing element in the push switch of the comparative example and a load applied from the pushing element and the movable member of the comparative example to the operator.

In the push switch 100 of the comparative example, the correlation between the load applied from the pushing element 50 to the operator and the travel distance of the pushing element 50 is, as in the case of the push switch 1 of the embodiment, divided into a first area A1, a second area A2, and a third area A3 as illustrated in FIG. 9. However, in the push switch 100 of the comparative example, the support 60 does not perform the invert action as described above. Therefore, at a time point at which the invert action of the movable member 3 is performed, the load acting on the operator is larger than in the push switch 1 of the present embodiment.

Specifically, in the push switch 1 of the present embodiment, the bottom load in the second area A2 is the sum of a load (about 1 (N)) applied from the support 6 to the operator and a load (about 1 (N)) applied from the movable member 3 and the pushing element 5 to the operator and is thus 2 (N) (see FIG. 7A). In contrast, in the push switch 100 of the comparative example, the bottom load in the second area A2 is the sum of a load (about 2 (N)) applied from the support 6 to the operator and a load (about 1 (N)) applied from the movable member 3 and the pushing element 5 to the operator and is thus 3 (N). Here, in the push switch 1 of the present embodiment, the magnitude of the difference B1 between the peak load and the bottom load in the second area A2 is about 2 (N). In contrast, in the push switch 100 of the comparative example, the magnitude of the difference B2 between the peak load and the bottom load in the second area A2 is about 1 (N). Thus, in the push switch 100 of the comparative example, the comfortableness (click feeling) provided to the operator is impaired as compared to the push switch 1 of the present embodiment.

In order to improve the comfortableness (click feeling) provided to the operator in the push switch 100 of the comparative example, for example, a movable member having a higher click ratio than the movable member 3 (hereinafter referred to as a "movable member of the comparative example") may be used in place of the movable member 3. As used herein. "click ratio" refers to the ratio of the magnitude of the difference between the peak load and the bottom load of the movable member to the peak load of the movable member. As shown by the long dashed short dashed line in FIG. 10A, in the movable member of the comparative example, a difference C2 between the peak load and the bottom load is larger than a difference C1 between the peak load and the bottom load of the movable member 3 of the present embodiment (see FIG. 7C).

Figure 10B:
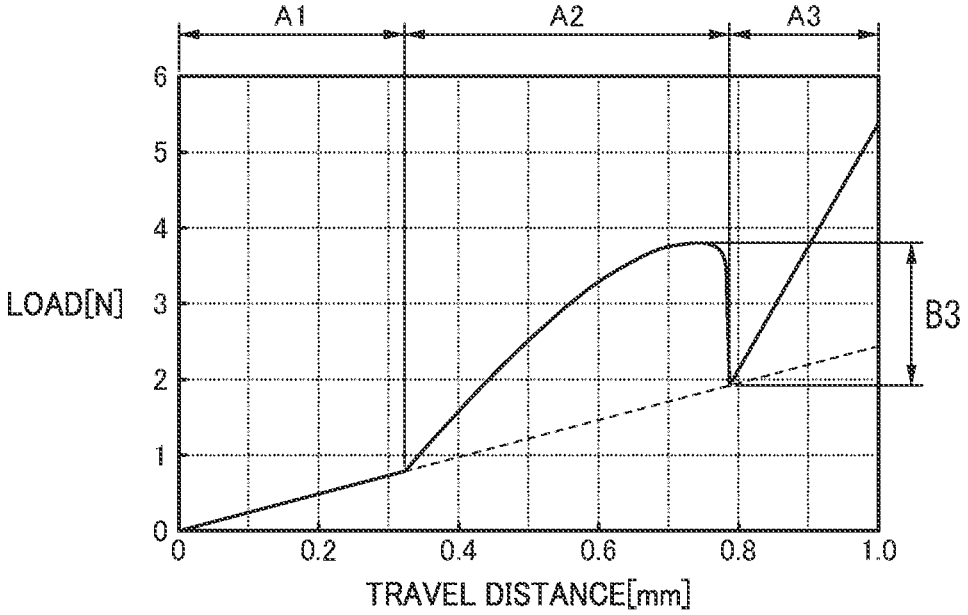
FIG. 10B is a correlation diagram between the travel distance of the pushing element in the push switch of the comparative example and the load applied from the pushing element to the operator.

In the push switch 100 of the comparative example adopting the movable member of the comparative example, the bottom load in the second area A2 substantially corresponds to the load applied from the support 60 to the operator and is about 2 (N) as illustrated in FIG. 10B. Therefore, in this aspect, the magnitude of a difference B3 between the peak load and the bottom load in the second area A2 is about 2 (N), and thus, the comfortableness (click feeling) similar to that obtained from the push switch 1 of the present embodiment is provided to the operator.

However, improvement of the click ratio of the movable member as in the case of the movable member of the comparative example is limited in terms of manufacturing. Even if the movable member as the movable member of the comparative example were manufacturable, adopting such a movable member in the push switch would not be realistic when complication of the manufacturing and manufacturing costs including cost of development are taken into consideration.

In contrast, in the push switch 1 of the present embodiment, the support 6 performs the invert action, and therefore, the load applied from the support 6 to the operator at the time point at which the invert action of the movable member 3 is performed is reduced as compared to the push switch 100 of the comparative example. Thus, the push switch 1 of the present embodiment provides satisfactory comfortableness (click feeling) to the operator without using a movable member having a high click ratio such as the movable member of the comparative example.

Moreover, the push switch 1 of the present embodiment has the advantage that the travel distance of the pushing element 5 required from a start of the push operation until the contact device 4 is switched ON (hereinafter referred to as an "ON travel distance") is increased as compared to the push switch 100 of the comparative example. That is, the push switch 100 of the comparative example has the problem that the load acting on the operator at the time point at which the invert action of the movable member 3 is performed increases as the ON travel distance increases, and the comfortableness (click feeling) is likely to be impaired. In contrast, in the push switch 1 of the present embodiment, the load applied from the support 6 to the operator transitions to a decrease during the push operation. Therefore, even when the ON travel distance increases, the load acting on the operator at the time point at which the invert action of the movable member 3 is performed is less likely to be increased. Thus, the push switch 1 of the present embodiment has the advantage that the ON travel distance may be increased without impairing the comfortableness (click feeling) as compared to the push switch 100 of the comparative example.

As a result, the push switch 1 of the present embodiment has the advantage that increasing the gap G1 enables the travel distance of the pushing element 5 in the first area A1 to be increased as compared to the push switch 100 of the comparative example. As described above, increasing the travel distance of the pushing element 5 in the first area A1 has the advantage that a rattle sound caused by vibration of the operation button 10 (see FIG. 1A) attached to the push switch 1 is reduced. That is, attaching the operation button 10 to the pushing element 5 with a prescribed load (pre-load) applied to the pushing element 5 enables the rattle of the operation button 10 to be easily reduced and thus enables the rattle sound caused by the rattle of the operation button 10 to be reduced.

Moreover, the prescribed load (pre-load) by the intermediate member (the operation button 10) may be set in the first area A1 in which the load is relatively small. In other words, When the prescribed load (pre-load) is set in the first area A1 in which the load is relatively small, the influence of the change in the load in the second area A2 over the feeling provided to the operator is small. For example, in a configuration in which the prescribed load (pre-load) is applied to a switch which has no first area A1 in which the load is relatively low, an operator has to start pushing the intermediate member from a location at which the load is relatively large. In this case, the peak load is reached and the contact device is thus switched ON immediately after the operator starts pushing, and therefore, the influence over the feeling provided to the operator is significant. In contrast, When the prescribed load (pre-load) is set as described in the present embodiment, such influence over the feeling is reduced, and preferable feeling is more likely to be provided to the operator.

Moreover, in the present embodiment, the pushing element 5 is made of solid rubber and has an elastic modulus smaller than the elastic modulus of the movable member 3. Therefore, in the present embodiment, after the invert action of the movable member 3, the pushing element 5 is uniformly compressed in the upward/downward direction in accordance with the operation force by the push operation. Thus, in the present embodiment, the prescribed travel distance (stroke) of the pushing element 5 after the invert action of the movable member 3 is also easily secured.

(4) Variations

The above-described embodiment is a mere example of various embodiments of the present disclosure. The above-described embodiment may be modified in various ways depending on design and the like as long as the object of the present disclosure is achieved. Variations of the above-described embodiment will be described below. The variations described below are applicable accordingly in combination.

Figure 11:
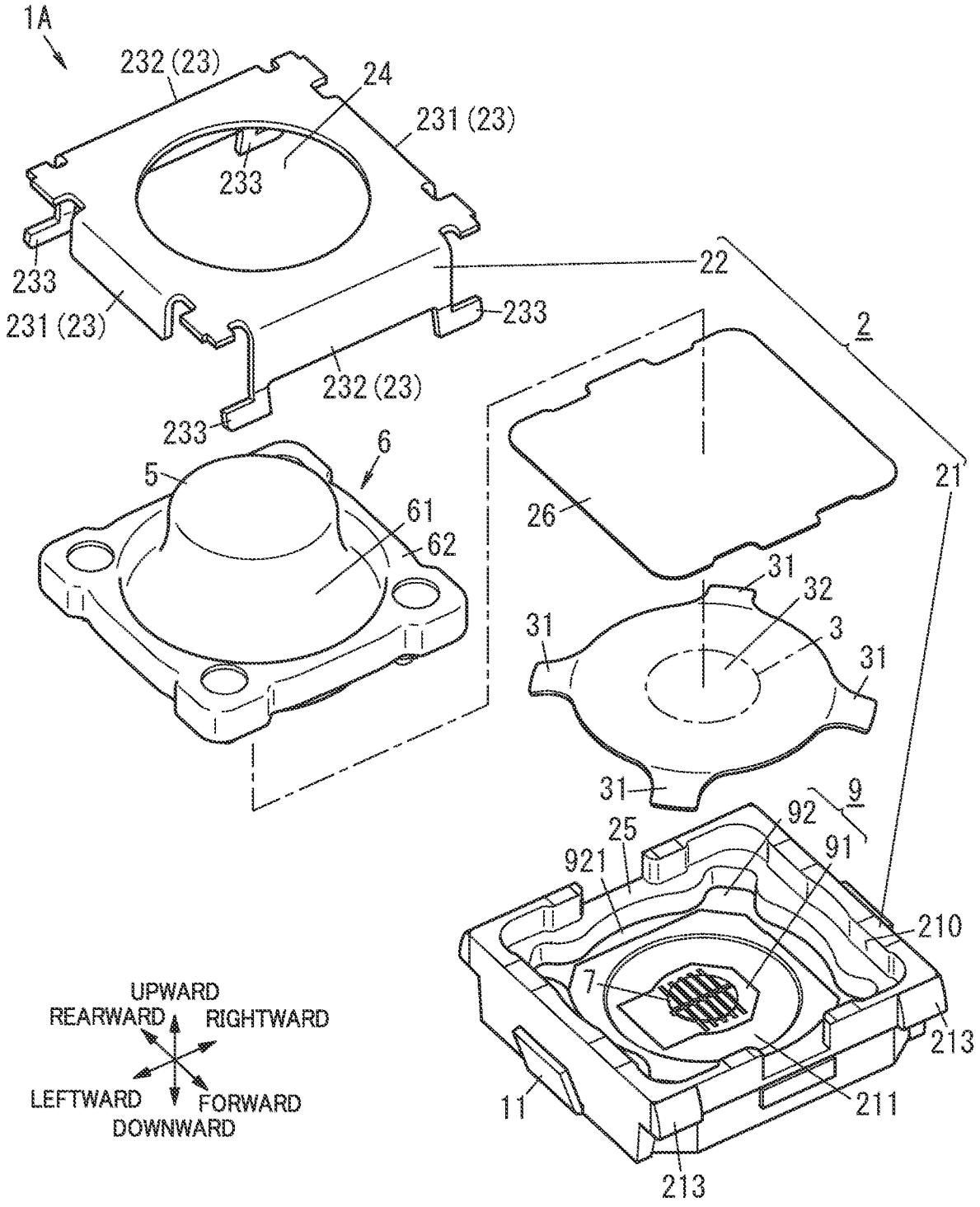
FIG. 11 is an exploded perspective view illustrating a push switch according to a variation of the one embodiment of the present disclosure.
Figure 12:
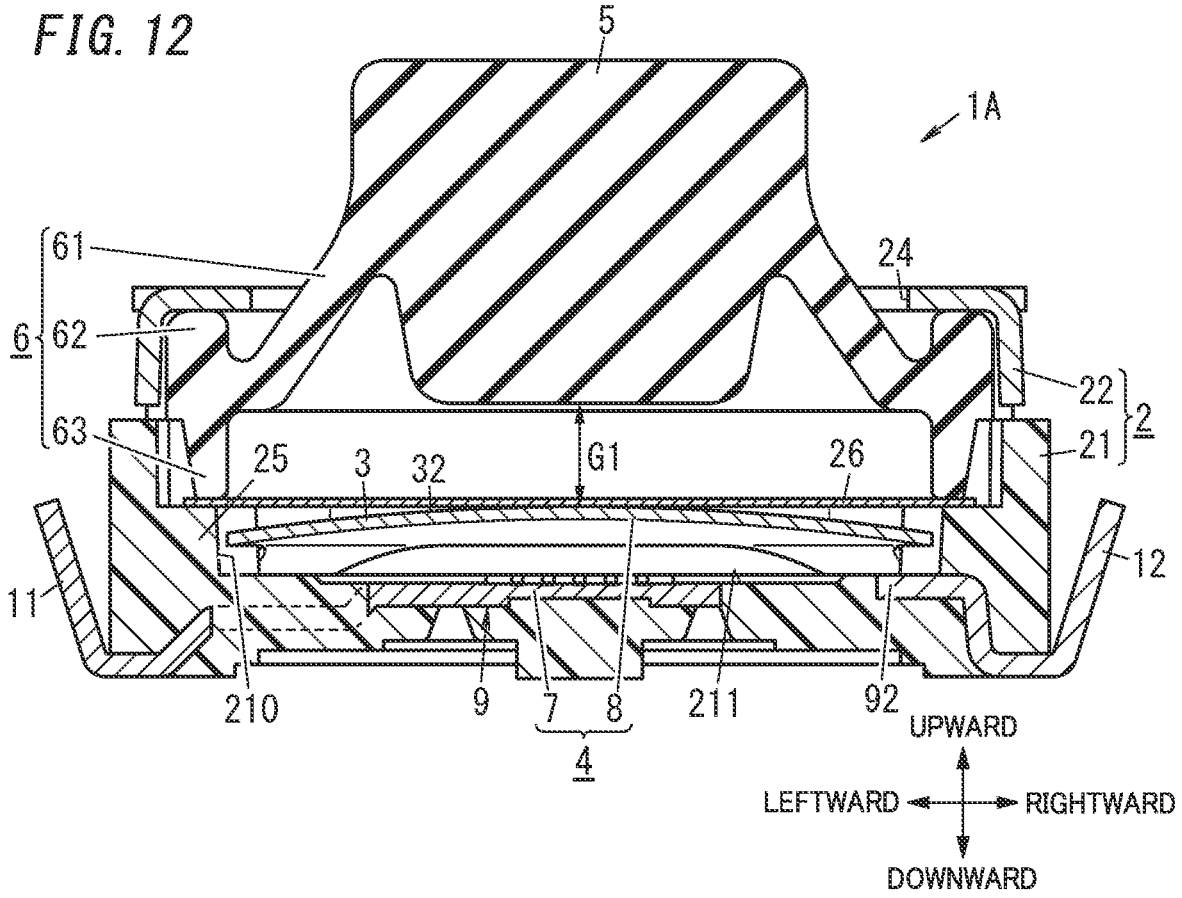
FIG. 12 is a cross sectional view schematically illustrating the push switch of the variation, where the push switch is not operated

In the above-described embodiment, the push switch may further include an insulating sheet. A push switch including the insulating sheet is hereinafter described as a "push switch 1A of the variation" with reference to FIGS. 11 and 12. The push switch 1A of the variation is different from the push switch 1 of the above-described embodiment in that a body 21 of a case 2 further includes a stepped part 25 and that an insulating sheet 26 is further provided.

The stepped part 25 is provided to an inner wall defining a recess 210 formed in the body 21 in a peripheral direction of the inner wall entirely and has an upper surface located recessed by a prescribed height from the uppermost surface of the body 21. Moreover, the height dimension (dimension in the upward/downward direction) of the stepped part 25 is uniform over the entire periphery of the stepped part 25. An outer peripheral edge of the insulating sheet 26 is placed on the upper surface of the stepped part 25. The width dimension (dimension in the rightward/leftward direction) of the upper surface of the stepped part 25 is at least a dimension which allows the outer peripheral edge of the insulating sheet 26 to be placed on the upper surface of the stepped part 25.

The insulating sheet 26 has a rectangular shape having an area which substantially covers the opening of the recess 210 and is made of an electrically insulating material. In particular, in the present variation, the insulating sheet 26 is desirably made of, for example, a material resistant to gas such as sulfur dioxide ($SO_2$) specifically, a resin material such as polytetrafluoroethylene (PTFE). Alternatively, the insulating sheet 26 may be made of, for example, a material, such as nylon 9T or a polyimide resin, resistant to gas.

The insulating sheet 26 has a lower surface to the entirety of which an adhesive is applied. Thus, the outer peripheral edge of the insulating sheet 26 is placed on the upper surface of the stepped part 25, and thereby, the insulating sheet 26 is attached to the upper surface of the stepped part 25 via the adhesive and is held by the case 2. Here, the insulating sheet 26 attached to the stepped part 25 is pushed from above by an extension part 63 integral with the pushing element 5. The extension part 63 has a height dimension (dimension in the upward/downward direction) set such that a lower end of the extension part 63 can apply a prescribed pressure to a corresponding site of the insulating sheet 26. With this configuration, the extension part 63 presses the outer peripheral edge of the insulating sheet 26, and therefore, the insulating sheet 26 is easily suppressed from being pulled into a space in which a contact device (the fixed contact 7 and the movable contact 8) are disposed when the push switch 1A is operated.

As described above, in the present variation, the space which is part of the recess 210 and in which the contact device is to be disposed is hermetically sealed with the insulating sheet 26. Therefore, the present variation has the advantage that gas such as sulfur dioxide is prevented from externally flowing to the contact device, and the gas is less likely to influence over the contact device.

Incidentally, the adhesive for the insulating sheet 26, for example, an adhesive made of resin, such as an acrylic-based adhesive or a silicone-based adhesive may be adopted. Such an adhesive made of a resin generally tends to soften under an a relatively hot environment. For example, when the push switch 1A is mounted on a wiring substrate of an electronic apparatus by reflow soldering, the adhesive of the insulating sheet 26 may be softened. However, in the push switch 1A, the outer peripheral edge of the insulating sheet 26 is pressed against the stepped part 25 by the extension part 63. Therefore, even if the adhesive of the insulating sheet 26 is softened, the insulating sheet 26 is less likely to be separated from the stepped part 25, and as a result, a hermetically closed state of the space in which the contact device is disposed is easily maintained. Thus, the push switch 1A is mounted on an electronic apparatus in a state where gas is less likely to influence over the contact device.

Note that in terms of securing a hermetically sealed property of the space in which the contact device is disposed, the adhesive is desirably applied to the entire lower surface of the insulating sheet 26, but the adhesive is applied at least to part of the lower surface of the insulating sheet 26 overlapping the stepped part 25.

In an aspect in which the adhesive is applied to the entire lower surface of the insulating sheet 26, another insulating sheet may be attached to the central part of the lower surface of the insulating sheet 26. In this case, the adhesive applied to the insulating sheet 26 is prevented from adhering to another member (e.g., the movable contact 8) when the push switch 1A is operated.

Instead of using the adhesive, the insulating sheet 26 may be welded to the stepped part 25 so as to be held by the case 2. Examples of the welding method include welding by laser irradiation and welding by ultrasonic wave.

In the above-described embodiment, the first threshold Th1 is smaller than the second threshold Th2, but this should not be construed as limiting. For example, the first threshold Th1 may be equal to the second threshold Th2. In this aspect, the support 6 performs invert action substantially simultaneously with the invert action of the movable member 3. Also this case has the advantage that at a time point at which the load applied from the movable member 3 to the operator reaches the bottom load, the load applied from the support 6 to the operator slightly decreases, and therefore, the comfortableness (click feeling) is less likely to be impaired.

In the above-described embodiment, the support 6 is made of rubber, but this should not be construed as limiting. For example, the support 6 may be made of metal. Moreover, in the above-described embodiment, the pushing element 5 and the support 6 are integral with each other but may be separated from each other. In this case, the support 6 is at least fixed to the pushing element 5 by, for example, an appropriate fixing means such as adhesion and the like. Moreover, the shape of the support 6 is not limited to the shape shown in the present embodiment but may have any shape that can perform invert action.

In the above-described embodiment, the movable member 3 is, but not limited to, a dome formed from a metal plate. For example, the movable member 3 may be a dome made of a resin. Moreover, the shape of the movable member 3 is not limited to the dome shape but is at least a shape that enables the invert action.

In the above-described embodiment, the elastic modulus of the pushing element 5 is smaller than the elastic modulus of the movable member 3, but this should not be construed as limiting. For example, the pushing element 5 may be as hard (have the same elastic modulus) as the movable member 3 or may be harder (have a higher elastic modulus) than the movable member 3.

In the above-described embodiment, the gap G1 is provided between the pushing element 5 and the movable member 3 in the non-operational state, but the gap G1 may be omitted. That is, in the non-operational state of the push switch 1, the lower end of the pushing element 5 may be in contact with the pressure receiving part 32 of the movable member 3. Moreover, in the push switch 1A of the variation, the lower end of the pushing element 5 may be in contact with the insulating sheet 26.

In the above-described embodiment, the stroke length of each of the push switches 1 and 1A, that is, the travel distance of the pushing element 5 from the non-operational state to when each of the push switches 1 and A is switched ON by the push operation may accordingly be set. For example, each of the push switches 1 and 1A may be a short stroke-type push switch having a relatively short stroke length, a long stroke-type push switch having a relatively long stroke length, or an medium stroke-type push switch corresponding to an intermediate type between the short stroke-type push switch and the long stroke-type push switch. Moreover, each of the push switches 1 and 1A are not limited to a normally OFF type but may be a normally ON type in which the push switch is switched ON only when operated. That is, the pushing element 5 of each of the push switches 1 and 1A may be configured to receive external force to push the movable member 3 from the OFF-position to the ON-position or vice versa.

In the above-described embodiment, the configuration of each of the push switches 1 and 1A is not limited to a configuration used for an operation section of an apparatus and operated by a person, but the push switch may be used for a sensor of, for example, an apparatus. When each of the push switches 1 and 1A is used for a sensor of an apparatus, each of the push switches 1 and 1A are used, for example, as a limit switch to detect the location of mechanical component such as an actuator.

In the above-described embodiment, the movable member 3 is one sheet of leaf spring but may include a stack of a plurality of leaf springs. In this case, depending on the number of leaf springs stacked, the magnitude of operation force required to bend the movable member 3, and operation feeling of each of the push switches 1 and 1A changes.

In the above-described embodiment, when the lower surface of the movable member 3 is provided with a conductive film, the conductive film is, for example, formed over the entire lower surface of the movable member 3. Alternatively, the conductive film may be partially formed at a site in contact with the fixed contact 7.

(Summary)

As described above, a push switch (1, 1A) of a first aspect includes: a case (2) including a fixed contact (7); a movable member (3), a pushing element (5), and a support (6). The movable member (3) includes a movable contact (8). The movable member (3) is disposed at a location to face the fixed contact (7) and is movable between an ON-position at which the movable contact (8) is in contact with the fixed contact (7) and an OFF-position at which the movable contact (8) is apart from the fixed contact (7). The pushing element (5) is disposed at a location to face the movable member (3) and is configured to receive external force to push the movable member (3). The support (6) is connected to the pushing element (5) and supports the pushing element (5) with respect to the case (2). The support (6) has such a property that until a travel distance of the pushing element (5) reaches a first threshold (Th1), a load applied from the support (6) to the pushing element (5) increases, and after the travel distance of the pushing element (5) reaches the first threshold Th1, the load applied from the support 6 to the pushing element (5) decreases. The movable member (3) has such a property that until the travel distance of the pushing element (5) reaches a second threshold (Th2), a load applied from the movable member (3) to the pushing element (5) increases, and when the travel distance of the pushing element (5) reaches the second threshold Th2, the load applied from the movable member (3) to the pushing element (5) decreases.

This aspect has the advantage that comfortableness (click feeling) provided to the operator when an operator gives a push operation to the pushing element (5) is less likely to be impaired.

In a push switch (1, 1A) of a second aspect referring to the first aspect, the first threshold (Th1) is smaller than the second threshold (Th2).

This aspect has the advantage that an invert action of the support (6) is performed before an invert action of the movable member (3) is performed, and therefore, at a time point at which the movable member (3) performs the invert action, the load applied from the support (6) via the pushing element (5) to the operator is easily satisfactorily reduced.

In a push switch (1, 1A) of a third aspect referring to the first or second aspect, the support (6) is made of rubber.

This aspect has the advantage that a sound generated by the support (6) coming into contact with another portion when the support (6) performs the invert action is reduced as compared to a case where the support (6) made of metal.

In a push switch (1, 1A) of a fourth aspect referring to the first or second aspect, the pushing element (5) and the support (6) are integral with other and are made of rubber.

This aspect has the advantage that a rattle sound generated by the pushing element (5) and the support (6) coming into contact with another portion when the support (6) performs the invert action is reduced as compared to the pushing element (5) and the support (6) which are made of metal.

In a push switch (1, 1A) of a fifth aspect referring to any one of the first to fourth aspects, the movable member (3) is made of metal.

This aspect has the advantage that downsizing is easily achieved as compared to a case where the movable member (3) is made of a resin.

In a push switch (1, 1A) of a sixth aspect referring to the fifth aspect the movable member (3) is a dome formed from a metal plate.

This aspect has the advantage that downsizing is easily achieved as compared to a case where the movable member (3) is a dome made of a resin.

In a push switch (1, 1A) of a seventh aspect referring to any one of the first to sixth aspects, the pushing element (5) has an elastic modulus smaller than an elastic modulus of the movable member (3).

This aspect has the advantage that comfortableness (click feeling) provided to the operator is improved as compared to a case where the movable member (3) is pushed by an item made of a material harder than the pushing element (5). Moreover, in this aspect, after the invert action of the movable member (3), the pushing element (5) is uniformly compressed in one direction (the upward/downward direction) in accordance with the operation force by the push operation. This also provides the advantage that the prescribed travel distance of the pushing element (5) after the invert action of the movable member (3) is easily secured.

In a push switch (1, 1A) of an eighth aspect referring to any one of the first to seventh aspects, between the pushing element 5 and the movable member 3, a gap G1 is provided in a state where no external force is applied.

This aspect has the advantage that an intermediate member (an operation button (10)) is attachable to the pushing element (5) with a prescribed load (pre-load) applied to the pushing element (5). Thus, this aspect has the advantage that the rattle of the intermediate portion is easily reduced, and thus, the rattle sound which may be caused by the rattle of the intermediate member is reduced. Moreover, setting the prescribed load (pre-load) in an area (first area (A1)) in which the load is relatively small reduces influence of a change in the load in an area (second area (A2)) in which the load is relatively large over the feeling provided to the operator, and thus, operator is likely to obtain preferable feeling.

In a push switch (1, 1A) of a ninth aspect referring to any one of the first to eighth aspects, the support (6) has a main part (61) having a circular truncated cone shape and a base part (62) to be placed on part (body (21)) of the case (2). In a direction (upward/downward direction) in which the pushing element (5) and the movable member (3) are aligned, the main part (61) has one end facing the pushing element (5) and connected to the pushing element (5) and the main part (61) has another end facing the movable member (3) and connected to the base part (62).

With this aspect, the support (6) which performs an invert action is disposed in a small projection area when viewed from above, and the outer shape of the push switch (1, 1A) is suppressed from increasing.

The configurations of the second to ninth aspects are not essential configurations of the push switch (1, 1A) and may be omitted accordingly.

REFERENCE SIGNS LIST

1, 1A PUSH SWITCH
2 CASE
3 MOVABLE MEMBER
5 PUSHING ELEMENT
6 SUPPORT
7 FIXED CONTACT
8 MOVABLE CONTACT
G1 GAP
Th1 FIRST THRESHOLD
Th2 SECOND THRESHOLD

The invention claimed is:

1. A push switch, comprising:

a case including a body having an upper surface and a bottom surface, the bottom surface having a fixed contact;

a movable member including a movable contact, disposed at a location to face the fixed contact, and movable between an ON-position at which the movable contact is in contact with the fixed contact and an OFF-position at which the movable contact is apart from the fixed contact;

a pushing element disposed at a location to face the movable member and configured to receive external force to push the movable member; and a support connected to the pushing element and supporting the pushing element with respect to the case, wherein until a travel distance of the pushing element reaches a first threshold, a load applied from the support to the pushing element increases, and after the travel distance of the pushing element reaches the first threshold, the load applied from the support to the pushing element decreases, wherein until the travel distance of the pushing element reaches a second threshold, a load applied from the movable member to the pushing element increases, and when the travel distance of the pushing element reaches the second threshold, the load applied from the movable member to the pushing element decreases, wherein the support is placed on the upper surface of the body, wherein the support has a main part having a circular truncated cone shape and a base part to be placed on part of the case, wherein in a direction in which the pushing element and the movable member are aligned, the main part has one end facing the pushing element and connected to the pushing element and the main part has another end facing the movable member and connected to the base part, and wherein the first threshold is smaller than the second threshold.

2. The push switch of claim 1, wherein the support is made of rubber.

3. The push switch of claim 2, wherein the movable member is made of metal.

4. The push switch of claim 3, wherein the movable member is a dome formed from a metal plate.

5. The push switch of claim 1, wherein the pushing element and the support are integral with each other and are made of rubber.

6. The push switch of claim 5, wherein the movable member is made of metal.

7. The push switch of claim 6, wherein the movable member is a dome formed from a metal plate.

8. The push switch of claim 1, wherein the movable member is made of metal.

9. The push switch of claim 8, wherein the movable member is a dome formed from a metal plate.

10. The push switch of claim 1, wherein the pushing element has an elastic modulus smaller than an elastic modulus of the movable member.

11. The push switch of claim 1, wherein between the pushing element and the movable member, a gap is provided in a state where no external force is applied.

12. A push switch comprising:

a case including a body having an upper surface and a bottom surface, the bottom surface having a fixed contact;

a movable member including a movable contact, disposed at a location to face the fixed contact, and movable between an ON-position at which the movable contact is in contact with the fixed contact and an OFF-position at which the movable contact is apart from the fixed contact;

a pushing element disposed at a location to face the movable member and configured to receive external force to push the movable member; and a support connected to the pushing element and supporting the pushing element with respect to the case, wherein until a travel distance of the pushing element reaches a first threshold, a load applied from the support to the pushing element increases, and after the travel distance of the pushing element reaches the first threshold, the load applied from the support to the pushing element decreases, wherein until the travel distance of the pushing element reaches a second threshold, a load applied from the movable member to the pushing element increases, and when the travel distance of the pushing element reaches the second threshold, the load applied from the movable member to the pushing element decreases, wherein the support is placed on the upper surface of the body, and wherein the body further has a recess, wherein the support includes a base part which is placed on the upper surface of the body and an extension part which is inserted in the recess and faces an inner side wall of the recess, wherein a gap is provided between the extension part and the inner side wall of the recess in a state where no external force is applied, and wherein the extension part is in contact with the inner side wall of the recess in a state where external force is applied.

* * * * *